US010737135B2

(12) United States Patent
Chuang

(10) Patent No.: US 10,737,135 B2
(45) Date of Patent: Aug. 11, 2020

(54) HANDLE EXERCISING DEVICE AND SET OF EXERCISING DEVICES

(71) Applicant: Lung-Fei Chuang, Taichung (TW)

(72) Inventor: Lung-Fei Chuang, Taichung (TW)

( * ) Notice: Subject to any disclaimer, the term of this patent is extended or adjusted under 35 U.S.C. 154(b) by 143 days.

(21) Appl. No.: 15/709,488

(22) Filed: Sep. 20, 2017

(65) Prior Publication Data

US 2019/0030390 A1 Jan. 31, 2019

(30) Foreign Application Priority Data

Jul. 26, 2017 (TW) ..... 106211008 U

(51) Int. Cl.

| | |
|---|---|
| ***A63B 21/00*** | (2006.01) |
| ***A63B 5/20*** | (2006.01) |
| ***A63B 21/055*** | (2006.01) |
| ***A63B 22/20*** | (2006.01) |
| ***A63B 23/12*** | (2006.01) |
| ***A63B 21/068*** | (2006.01) |

(Continued)

(52) U.S. Cl.

CPC ..... *A63B 21/4035* (2015.10); *A63B 5/20* (2013.01); *A63B 21/0004* (2013.01); *A63B 21/00043* (2013.01); *A63B 21/0557* (2013.01); *A63B 21/068* (2013.01); *A63B 21/4043* (2015.10); *A63B 21/4049* (2015.10);

(Continued)

(58) Field of Classification Search

CPC ..... A63B 21/4035; A63B 24/0062; A63B 21/4049; A63B 21/00043; A63B 23/1236; A63B 22/20; A63B 21/0557; A63B 5/20; A63B 2220/833; A63B 2220/17; A63B 21/0552; A63B 21/0023; A63B 23/16; A63B 23/03525; A63B 23/0211; A63B 23/02; A63B 21/068; A63B 21/0004; A63B 21/4034; A63B 2220/803; A63B 2220/40; A63B 2210/50; A63B 2208/0295; A63B 2208/0219; A63B 2071/027; A63B 23/1209; A63B 21/4043

See application file for complete search history.

(56) References Cited

U.S. PATENT DOCUMENTS

| | | | |
|---|---|---|---|
| 7,175,573 | B1 | 2/2007 | Huang |
| 7,628,735 | B1 | 12/2009 | Hsu |

(Continued)

FOREIGN PATENT DOCUMENTS

| | | | |
|---|---|---|---|
| CN | 101411937 | A | 4/2009 |
| CN | 105617639 | A | 6/2016 |

(Continued)

*Primary Examiner* — Sundhara M Ganesan

(74) *Attorney, Agent, or Firm* — CKC & Partners Co., LLC

(57) ABSTRACT

The present disclosure provides a handle exercising device and a set of exercising devices. The handle exercising device includes a handle body, a chamber, a buckle portion, a release button, and two female buckles. The handle body has a top surface and a bottom surface. The chamber is disposed in the handle body along an axial direction of the handle body, wherein the chamber has an opening facing one end of the handle body. The buckle portion is disposed in the chamber and buckles a predetermined assembly inserting the chamber via the opening. The release button is disposed at the top surface of the handle body and connected with the buckle portion to release a buckling status of the buckle portion. The female buckles are disposed at the bottom surface of the handle body and arranged in parallel along the axial direction.

2 Claims, 27 Drawing Sheets

(51) Int. Cl.

| | |
|---|---|
| ***A63B 23/02*** | (2006.01) |
| ***A63B 23/16*** | (2006.01) |
| ***A63B 23/035*** | (2006.01) |
| ***A63B 24/00*** | (2006.01) |
| ***A63B 21/002*** | (2006.01) |
| ***A63B 71/02*** | (2006.01) |

(52) U.S. Cl.

CPC ..... *A63B 22/20* (2013.01); *A63B 23/02* (2013.01); *A63B 23/0211* (2013.01); *A63B 23/03525* (2013.01); *A63B 23/1236* (2013.01); *A63B 23/16* (2013.01); *A63B 24/0062* (2013.01); *A63B 21/0023* (2013.01); *A63B 21/0552* (2013.01); *A63B 21/4034* (2015.10); *A63B 23/1209* (2013.01); *A63B 2071/027* (2013.01); *A63B 2208/0219* (2013.01); *A63B 2208/0295* (2013.01); *A63B 2210/50* (2013.01); *A63B 2220/17* (2013.01); *A63B 2220/40* (2013.01); *A63B 2220/803* (2013.01); *A63B 2220/833* (2013.01)

(56) References Cited

U.S. PATENT DOCUMENTS

| | | | | |
|---|---|---|---|---|
| 9,067,104 | B1 * | 6/2015 | Kim | A63B 22/20 |
| 2010/0317496 | A1 * | 12/2010 | Abranchess | A63B 21/0004 482/141 |
| 2011/0230313 | A1 * | 9/2011 | Gamboa | A63B 22/20 482/51 |
| 2011/0300999 | A1 * | 12/2011 | Cavaliere | A63B 21/0608 482/108 |
| 2013/0072365 | A1 * | 3/2013 | Ross | A63B 21/1636 482/141 |
| 2013/0217549 | A1 * | 8/2013 | Marji | A63B 21/068 482/132 |
| 2013/0316886 | A1 * | 11/2013 | Lynch | A63B 26/003 482/146 |
| 2014/0066274 | A1 * | 3/2014 | Kassel | A63B 21/0414 482/141 |
| 2015/0190672 | A1 * | 7/2015 | Rost | A63B 23/0355 482/93 |
| 2016/0158590 | A1 * | 6/2016 | Bowles | A63B 21/4034 482/93 |
| 2017/0080271 | A1 | 3/2017 | Miller et al. | |
| 2018/0043213 | A1 * | 2/2018 | Poeschl | A63B 26/00 |
| 2019/0143168 | A1 * | 5/2019 | Chang | A63B 21/4035 |

FOREIGN PATENT DOCUMENTS

| | | | |
|---|---|---|---|
| DE | 202007009819 | U1 | 11/2007 |
| KR | 200249803 | Y1 | 9/2001 |
| KR | 20090037265 | A | 4/2009 |
| WO | 2008003057 | A2 | 1/2008 |
| WO | 2014036123 | A1 | 3/2014 |

* cited by examiner

500

600

800

995

HANDLE EXERCISING DEVICE AND SET OF EXERCISING DEVICES

RELATED APPLICATIONS

This application claims priority to Taiwan Application Serial Number 106211008, filed Jul. 26, 2017, which is herein incorporated by reference.

BACKGROUND

Technical Field

The present disclosure relates to an exercising device. More particularly, the present disclosure relates to a handle exercising device and a set of exercising devices including the handle exercising device.

Description of Related Art

Along with the prevalence of the fitness industry, various exercising devices have been available on the market, and some of them try to draw attentions from consumers by providing novel exercising ways. However, the exercising ways provided by these devices are usually highly limited, such that the users cannot use them to perform various movements, and hence the variations and fun will be less.

For example, a conventional push-up bar is usually configured with an integrally formed support (or a rotary plate) and a handle portion, wherein the support is used to stand on the floor, and the handle connected with the support (or the rotary plate) is used for the user to hold and pushes the floor via the support (or the rotary plate), such that the user may perform a push-up operation. However, the conventional push-up bar is difficult for the user to perform the other movement, and hence less variations can be achieved. Besides, after the conventional push-up bar has been used for a while, the user may not be willing to use it because the exercising way thereof is less interesting.

For another example, a conventional ab-roller usually has two handles and a roller that can pivotally rotate between the handles. The user may hold the handles with both hands and push out the conventional ab-roller out in a standing position or kneeling position. Next, the user may pull the conventional ab-roller back to be back to the standing position or kneeling position again, such that the training effects can be achieved. However, it is still difficult for the user to use the conventional ab-roller to perform other movements, and hence less variability can be achieved as well.

Therefore, to the people having ordinary skills in the art, it is important to design an exercising device that can provide less limitation, more variability, and more fun.

SUMMARY

The present disclosure provides a handle exercising device used with a predetermined assembly. The handle exercising device includes a handle body, a chamber, a buckle portion, a release button, and two female buckles. The handle body has a top surface and a bottom surface. The chamber is disposed in the handle body along an axial direction of the handle body, wherein the chamber has an opening facing one end of the handle body. The buckle portion is disposed in the chamber and buckles the predetermined assembly inserting the chamber via the opening. The release button is disposed at the top surface of the handle body and connected with the buckle portion to release a buckling status of the buckle portion. The female buckles are disposed at the bottom surface of the handle body and arranged in parallel along the axial direction.

The present disclosure provides an exercising device set including a roller exercising device, a connecting rod, a first handle exercising device, and a second handle exercising device. The roller exercising device has a central through hole. The connecting rod penetrates the central through hole of the roller exercising device, wherein two reeds are disposed on the connecting rod, and two ends of the connecting rod form two inserting portions. Each of the first handle exercising device and the second handle exercising device includes a handle body, a chamber, a buckle portion, a release button, and two female buckles. The handle body has a top surface and a bottom surface. The chamber is disposed in the handle body along an axial direction of the handle body, wherein the chamber has an opening facing one end of the handle body. The buckle portion is disposed in the chamber. The release button is disposed at the top surface of the handle body and connected with the buckle portion to release a buckling status of the buckle portion. The female buckles are disposed at the bottom surface of the handle body and arranged in parallel along the axial direction. The two inserting portions of the connecting rod respectively insert the chamber of the first handle exercising device and the chamber of the second handle exercising device, the reeds are respectively buckled by the buckle portion of the first handle exercising device and the buckle portion of the second handle exercising device, and the roller exercising device, the connecting rod, the first handle exercising device, and the second handle exercising device are combined for a rolling operation.

The present disclosure provides an exercising device set including a handle exercising device and a rotary plate. The handle exercising device includes a handle body, a chamber, a buckle portion, a release button, and two female buckles. The handle body has a first top surface and a bottom surface. The chamber is disposed in the handle body along an axial direction of the handle body, wherein the chamber has an opening facing one end of the handle body. The buckle portion is disposed in the chamber and buckles an inserting portion inserting the chamber via the opening. The release button is disposed at the first top surface of the handle body and connected with the buckle portion to release a buckling status of the buckle portion. The female buckles are disposed at the bottom surface of the handle body and arranged in parallel along the axial direction. The rotary plate includes a second top surface and tow supports. The supports are disposed at the second top surface and extend toward a normal direction of the second top surface, wherein two male buckles are disposed at tops of the supports, and the two male buckles correspond to the two female buckles of the handle exercising device. The two male buckles of the rotary plate buckle the two female buckles of the handle exercising device for a push-up operation.

The present disclosure provides an exercising device set including a rope, a first handle exercising device, and a second handle exercising device. The rope has two inserting portions disposed at two ends thereof, wherein two reeds are disposed on the two inserting portions. Each of the first handle exercising device and the second handle exercising device includes a handle body, a chamber, a buckle portion, a release button, and two female buckles. The handle body has a top surface and a bottom surface. The chamber is disposed in the handle body along an axial direction of the handle body, wherein the chamber has an opening facing one end of the handle body. The buckle portion is disposed in the chamber. The release button is disposed at the top surface of the handle body and connected with the buckle portion to release a buckling status of the buckle portion. The female buckles are disposed at the bottom surface of the handle body and arranged in parallel along the axial direction. The inserting portions of the rope respectively inserts the chamber of the first handle exercising device and the chamber of the second handle exercising device, the reeds are respectively buckled by the buckle portion of the first handle exercising device and the buckle portion of the second handle exercising device, and the rope, the first handle exercising device, and the second handle exercising device are combined for a jumping rope operation.

The present disclosure provides an exercising device set including a first handle case, a second handle case, an elastic rope, a first handle exercising device, and a second handle exercising device. The first handle case and the second handle case are U-shaped, two ends of each of the first handle case and the second handle case are disposed with two through holes, the through holes on the first handle case are aligned with each other, and the through holes on the second handle case are aligned with each other. The elastic rope has two ends respectively connected with the first handle case and the second handle case. Each of the first handle exercising device and the second handle exercising device includes a handle body, a chamber, a buckle portion, a release button, and two female buckles. The handle body has a top surface and a bottom surface. The chamber is disposed in the handle body along an axial direction of the handle body, wherein the chamber has an opening facing one end of the handle body. The buckle portion is disposed in the chamber. The release button is disposed at the top surface of the handle body and connected with the buckle portion to release a buckling status of the buckle portion. The female buckles are disposed at the bottom surface of the handle body and arranged in parallel along the axial direction. The handle body of the first handle exercising device penetrates the through holes of the first handle case, the second handle exercising device penetrates the through holes of the second handle case, and the first handle case, the second handle case, the elastic rope, the first handle exercising device, and the second handle exercising device are combined as a pulling rope.

The present disclosure provides a handle exercising device used with a predetermined assembly. The handle exercising device includes a handle body, an accommodating space, an engaging portion, and a female buckle. The handle body has a top surface and a bottom surface. The accommodating space is disposed in the handle body along an axial direction of the handle body, wherein the accommodating space has an opening facing one end of the handle body. The engaging portion is disposed in the accommodating space and engaging the predetermined assembly inserting the accommodating space via the opening. The female buckle is disposed at the bottom surface of the handle body and closer to one end of the handle body.

BRIEF DESCRIPTION OF THE DRAWINGS

The present disclosure can be more fully understood by reading the following detailed description of the embodiment, with reference made to the accompanying drawings as follows.

DETAILED DESCRIPTION

Figure 1A:
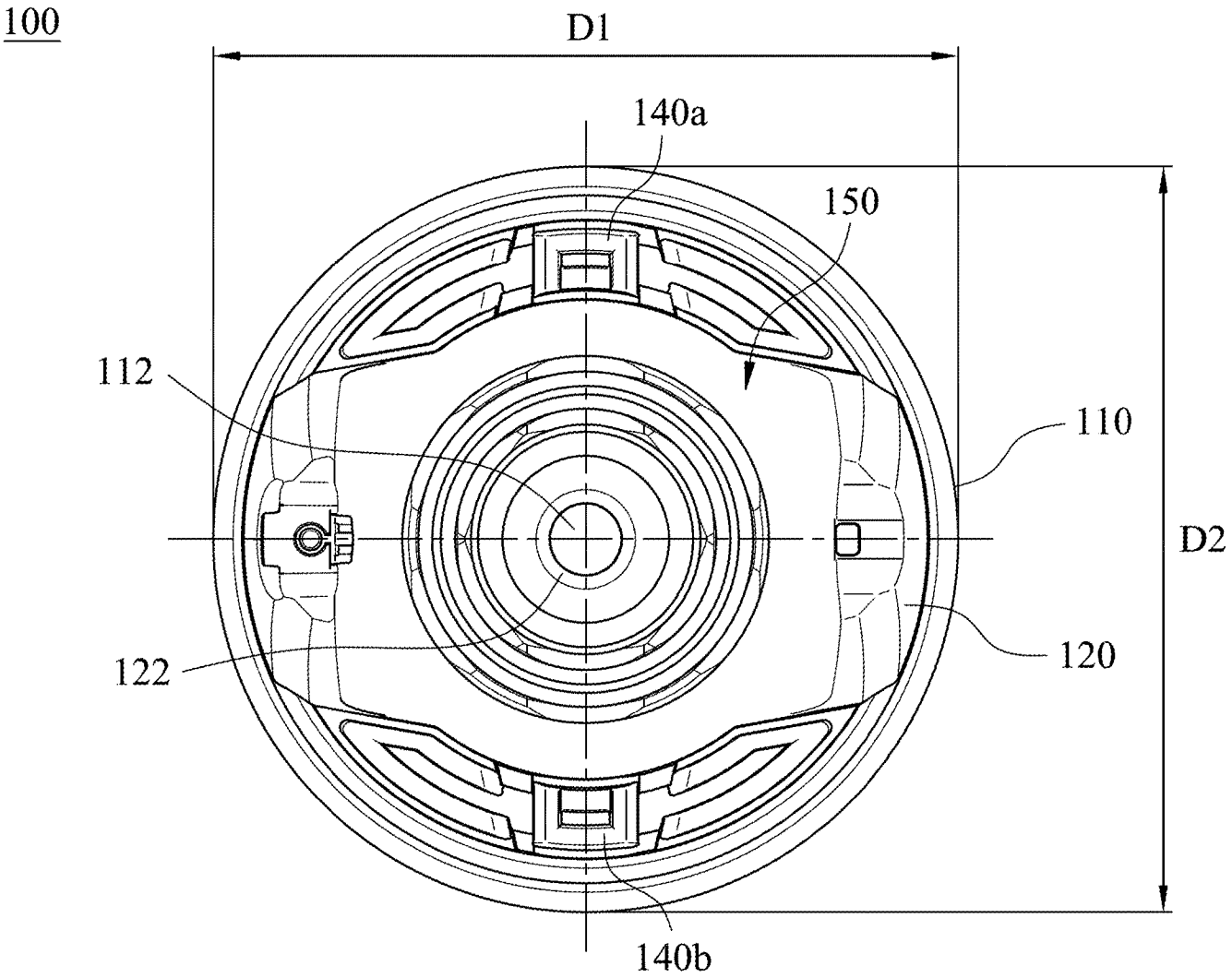
FIG. 1A is a top view of a first roller exercising device of an embodiment of the present disclosure.
Figure 1B:
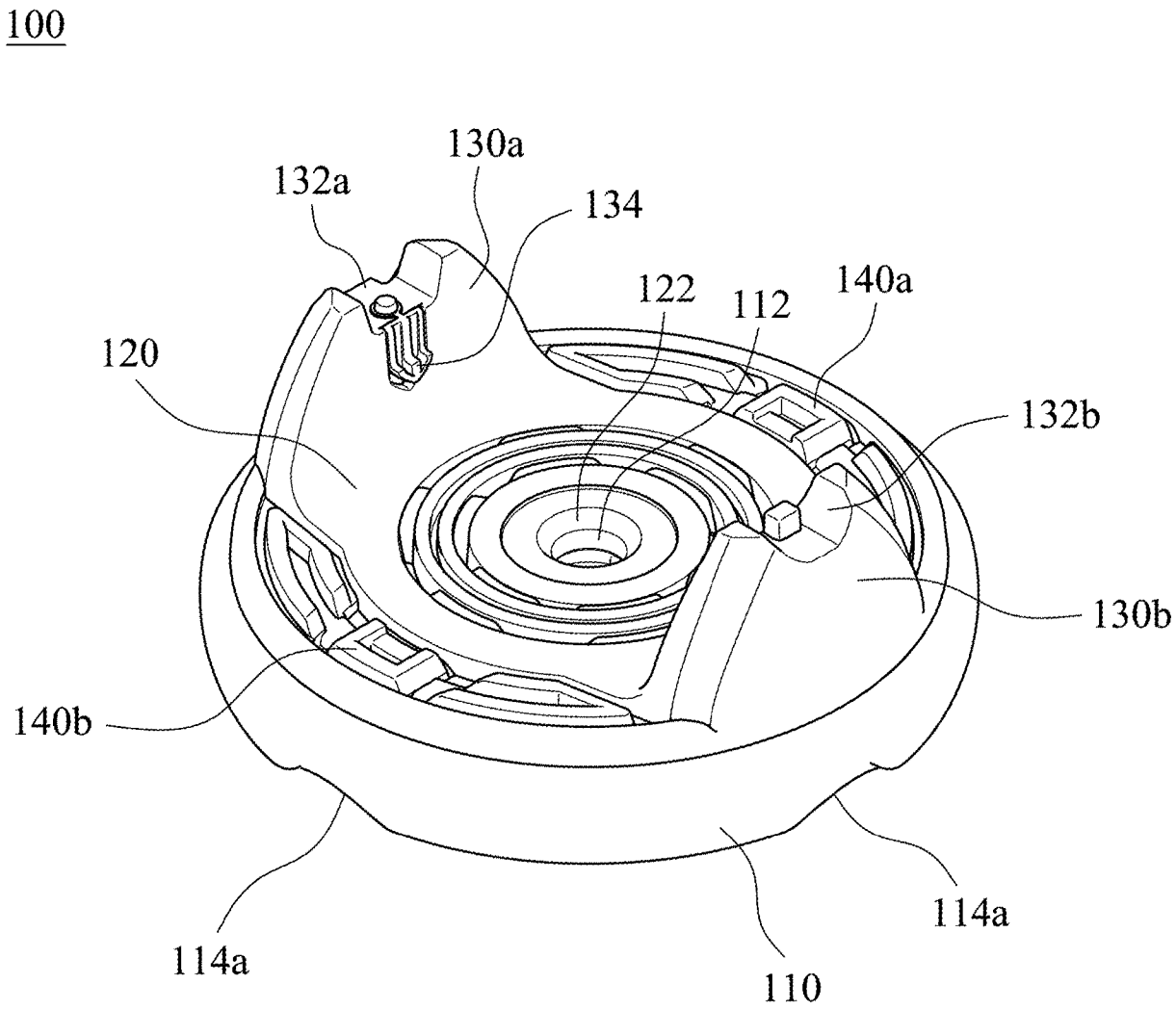
FIG. 1B is a 3-D view of the first roller exercising device of FIG. 1A.
Figure 1C:
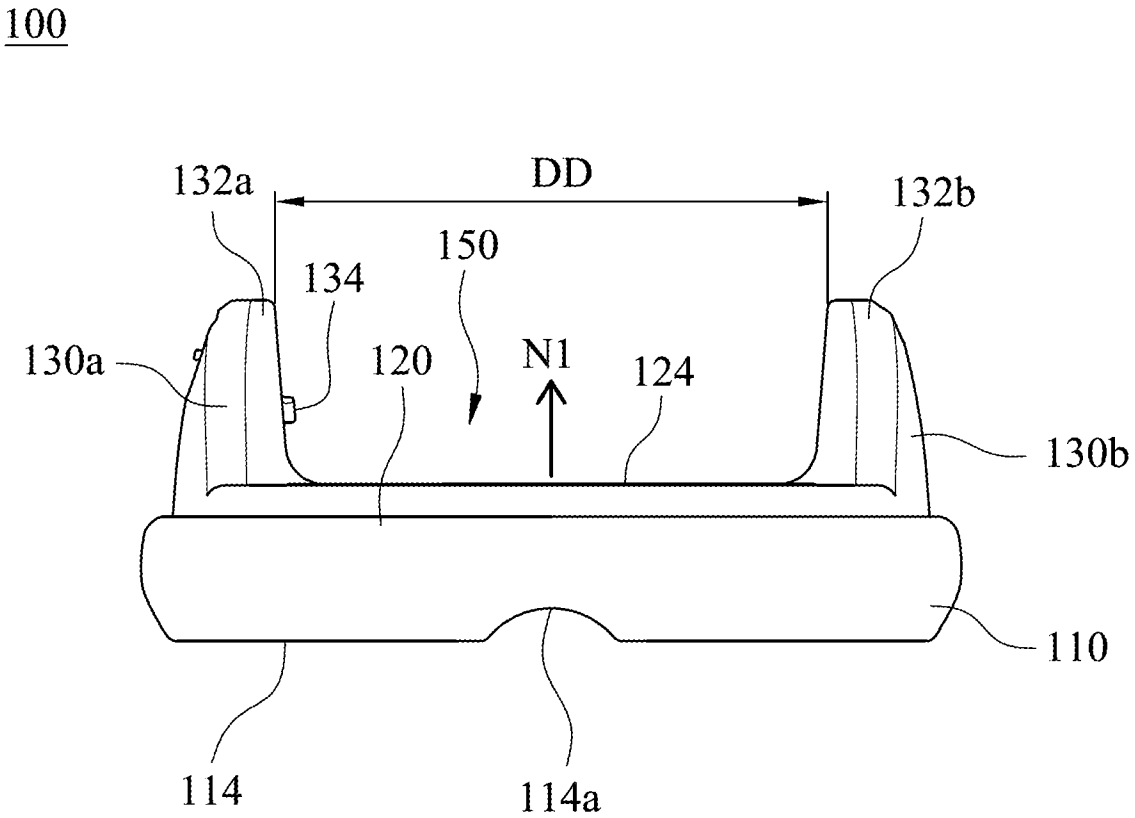
FIG. 1C is a side view of the first roller exercising device of FIG. 1A.

See FIG. 1A, FIG. 1B, and FIG. 1C, wherein FIG. 1A is a top view of a first roller exercising device 100 of an embodiment of the present disclosure, FIG. 1B is a 3-D view of the first roller exercising device 100 of FIG. 1A, and FIG. 1C is a side view of the first roller exercising device 100 of FIG. 1A. In the present embodiment, the first roller exercising device 100 may be used with a predetermined assembly to form various exercising devices for the user to perform various movements. Detailed discussion will be provided hereinafter.

As shown in FIG. 1A to FIG. 1C, the first roller exercising device 100 includes a base 110, a rotary plate 120, a support 130*a*, a support 130*b*, a female buckle 140*a*, and a female buckle 140*b*. The base 110 has a first central through hole 112. The rotary plate 120 is rotatably connected with the base 110 and has a second central through hole 122, a first diameter D1, and a second diameter D2, wherein the first diameter D1 is perpendicular to the second diameter D2, and the second central through hole 122 corresponds to the first central through hole 112. The support 130*a* and the support 130*b* are respectively disposed at two ends of the first diameter D1 and extend toward a normal direction N1 of a top surface 124 of the rotary plate 120, wherein a male buckle 132*a* and a male buckle 132*b* are respectively disposed at tops of the support 130*a* and the support 130*b*. The female buckle 140*a* and the female buckle 140*b* are respectively disposed at two ends of the second diameter D2 and dent the top surface 124 of the rotary plate 120, wherein the female buckle 140*a* and the female buckle 140*b* correspond to the male buckle 132*a* and the male buckle 132*b*, and the predetermined assembly can be detachably assembled with the female buckle 140*a*, the female buckle 140*b*, the male buckle 132*a*, and the male buckle 132*b*.

In one embodiment, the male buckle 132*a* and the male buckle 132*b* may be male buckling elements, and a release button 134 may be disposed on the support 130*a* (or the support 130*b*) to release a buckling status of the support 130*a* (or the support 130*b*). Furthermore, a predetermined distance DD may exist between the support 130*a* and the support 130*b*, such that a stepping portion 150 may be formed between the support 130*a* and the support 130*b*. Besides, a bottom surface 114 of the base 110 may be disposed with at least two limiting slots 114*a*, and the limiting slots 114*a* are disposed at two ends of the diameter of the bottom surface 114. Noted that there are limiting slots (not shown because of the viewing angle of FIG. 1B) on the other sides of the two limiting slots 114*a*.

Figure 2A:
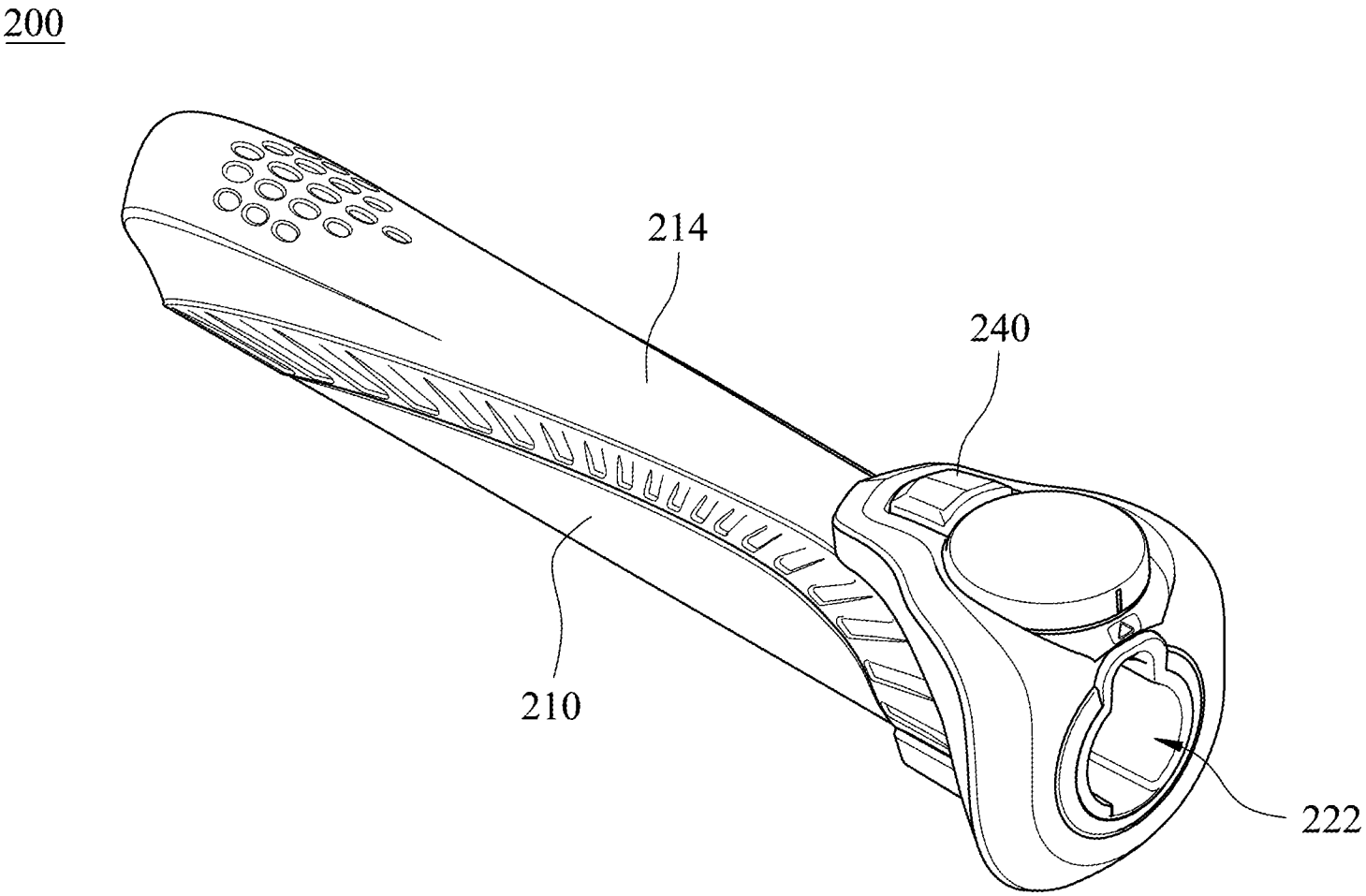
FIG. 2A is a 3-D view of the handle exercising device of one embodiment of the present disclosure.
Figure 2B:
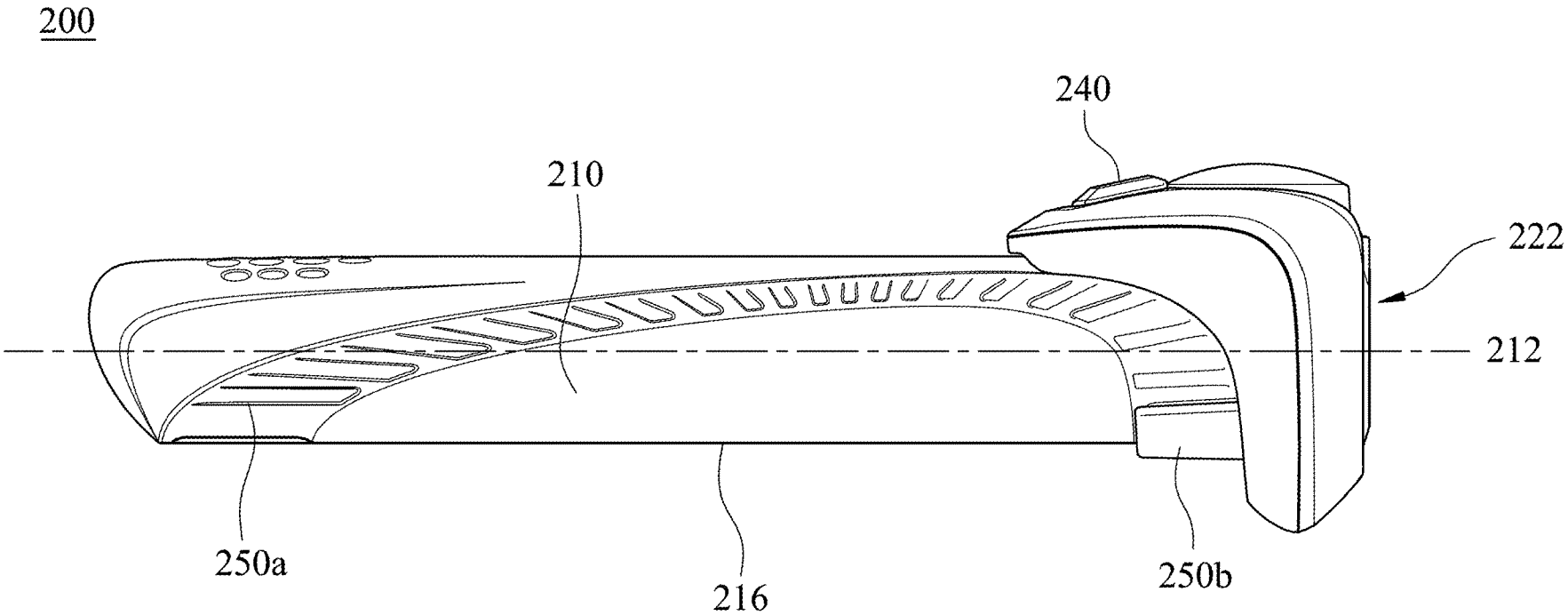
FIG. 2B is a side view of the handle exercising device of FIG. 2A.
Figure 2C:
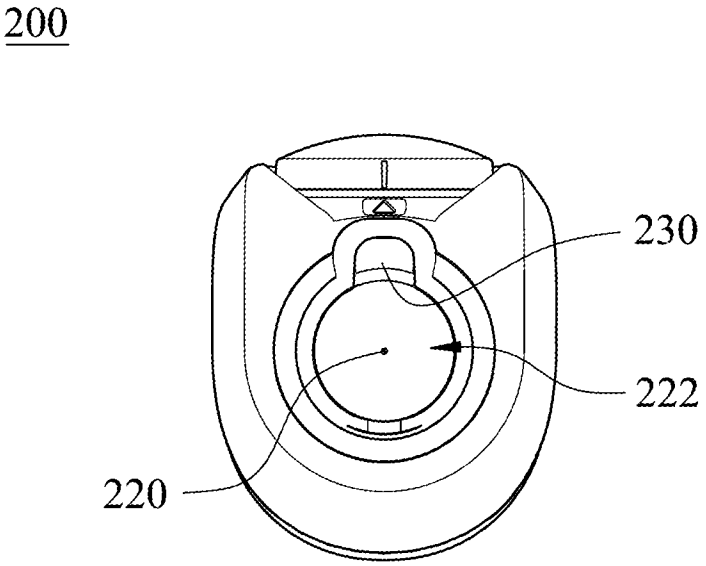
FIG. 2C is a front view of the handle exercising device of FIG. 2A.

In various embodiments, the predetermined assembly may be any exercising devices that can be assembled with the first roller exercising device 100 to provide predetermined functions, such as a handle exercising device 200 shown in FIG. 2A, FIG. 2B, and FIG. 2C.

See FIG. 2A, FIG. 2B, and FIG. 2C, wherein FIG. 2A is a 3-D view of the handle exercising device 200 of one embodiment of the present disclosure, FIG. 2B is a side view of the handle exercising device 200 of FIG. 2A, and FIG. 2C is a front view of the handle exercising device 200 of FIG. 2A. As shown in FIG. 2A, FIG. 2B, and FIG. 2C, the handle exercising device 200 includes a handle body 210, a chamber 220, a buckle portion 230, a release button 240, a female buckle 250*a*, and a female buckle 250*b*. The handle body 210 has a top surface 214 and a bottom surface 216. The chamber 220 is disposed in the handle body 210 along an axial direction 212 of the handle body 210, wherein the chamber 220 has an opening 222 facing one end of the handle body 210. The buckle portion 230 is disposed in the chamber 220 and buckles the predetermined assembly inserting the chamber 220 via the opening 222. The release button 240 is disposed at the top surface 214 of the handle body 210 and connected with the buckle portion 230 to release a buckling status of the buckle portion 230. The female buckle 250*a* and the female buckle 250*b* are disposed at the bottom surface 216 of the handle body 210 and arranged in parallel along the axial direction 212.

In one embodiment, a distance between the female buckle 250*a* and the female buckle 250*b* may be wider than a palm for facilitating the user to hold. Besides, the female buckle 250*a* and the female buckle 250*b* may correspond to the male buckle 130*a* and the male buckle 130*b* of the first roller exercising device 100 shown in FIG. 1A. That is, the male buckle 130*a* and the male buckle 130*b* of the first roller exercising device 100 may respectively buckle the female buckle 250*a* and the female buckle 250*b* of the handle exercising device 200.

Figure 3A:
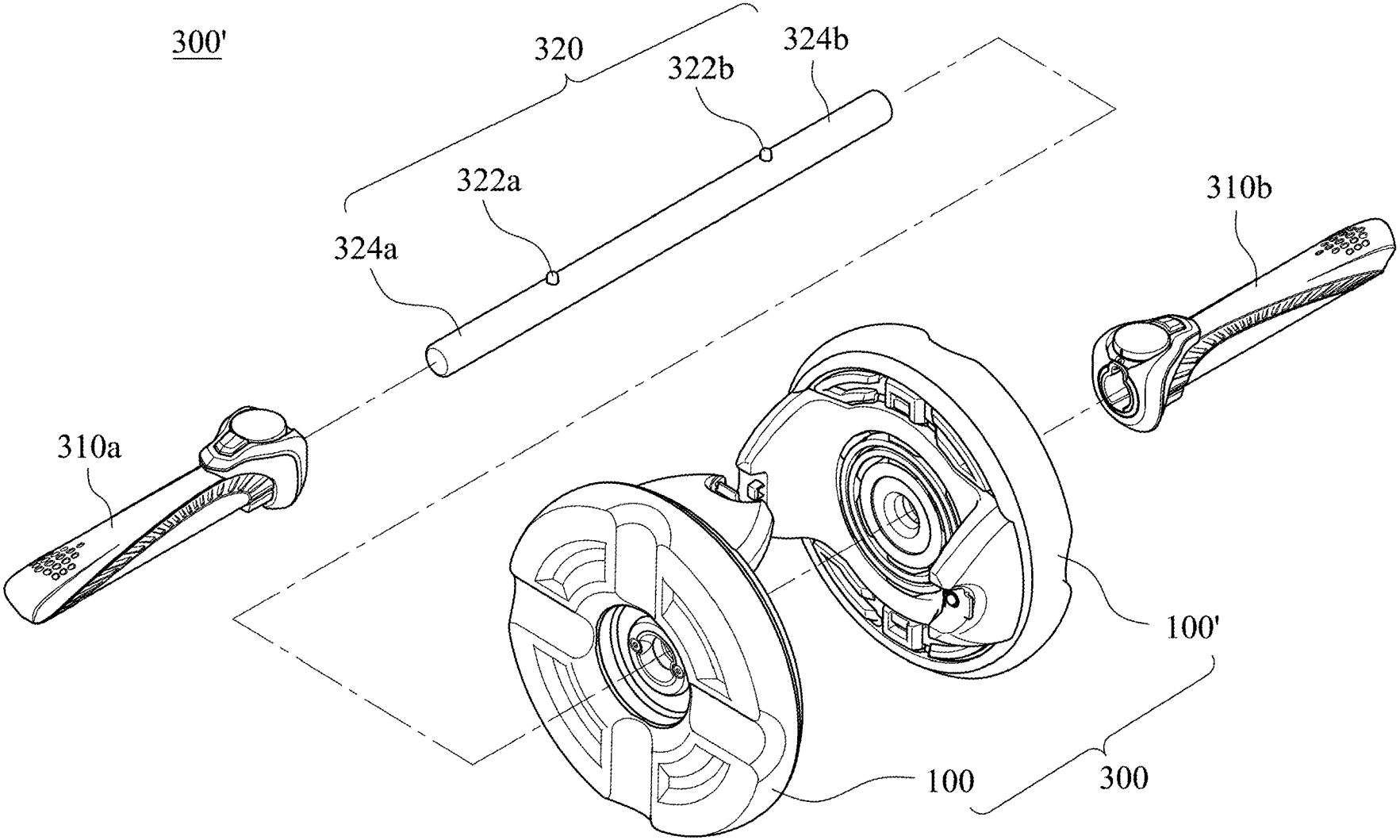
FIG. 3A is a schematic diagram of assembling the first roller exercising device with other predetermined assemblies to form an exercising device according to one embodiment of the present disclosure.
Figure 3B:
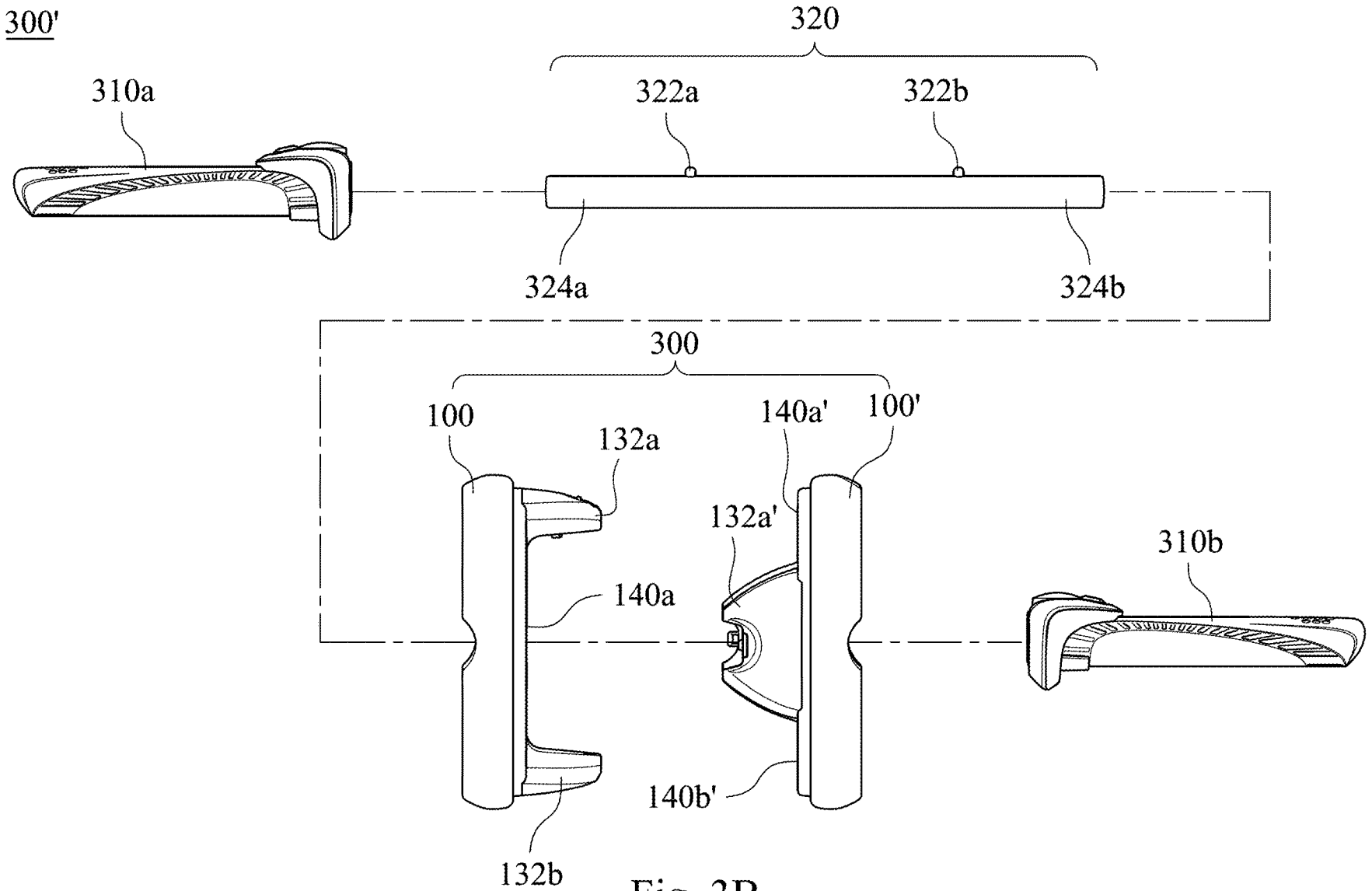
FIG. 3B is a side view of the exercising device of FIG. 3A.
Figure 3C:
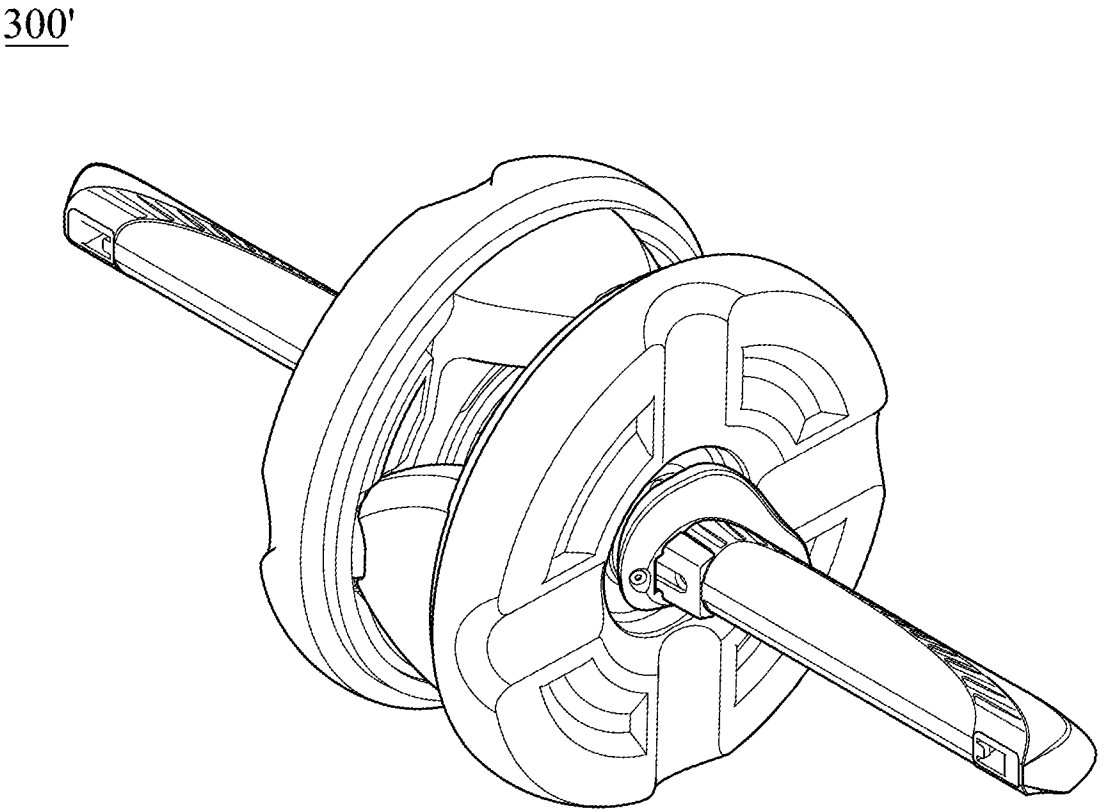
FIG. 3C is a schematic diagram of the assembled exercising device according to FIG. 3A.

See FIG. 3A, FIG. 3B, and FIG. 3C, wherein FIG. 3A is a schematic diagram of assembling the first roller exercising device 100 with other predetermined assemblies to form an exercising device 300' according to one embodiment of the present disclosure, FIG. 3B is a side view of the exercising device 300' of FIG. 3A, and FIG. 3C is a schematic diagram of the assembled exercising device 300' according to FIG. 3A. In the present embodiment, the predetermined assemblies include a second roller exercising device 100', a handle 310*a*, a handle 310*b*, and a connecting rod 320, wherein the handle 310*a* and the handle 310*b* may be the same as the handle exercising device 200 shown in FIG. 2A, but the present disclosure is not limited thereto.

The second roller exercising device 100' may be the same as the first roller exercising device 100. In this case, the male buckle 130*a* and the male buckle 130*b* of the first roller exercising device 100 may respectively buckle the female buckle 140*a'* and the female buckle 140*b'* of the second roller exercising device 100'. Meanwhile the male buckle 130*a'* of the second roller exercising device 100' may buckle the female buckle 140*a* of the first roller exercising device 100, such that the first roller exercising device 100 and the second roller exercising device 100' may be combined with each other to form a roller exercising device 300 in a face-to-face way.

Moreover, the connecting rod 320 may penetrate the first central through hole 112 and the second central through hole 122 of the first roller exercising device 100 and penetrate the first central through hole (not labelled) and the second central through hole (not labelled) of the second roller exercising device 100', such that the roller exercising device 300 may pivotally rotate on the connecting rod 320.

In one embodiment, reeds 322*a* and 322*b* may be disposed on the connecting rod 320, and two ends of the connecting rod 320 may form an inserting portion 324*a* and an inserting portion 324*b*. In this case, the handle 310*a* and the handle 310*b* may sleeve on the two ends of the connecting rod 320. Specifically, the inserting portion 324*a* and the inserting portion 324*b* of the connecting rod 320 may respectively insert the chambers (not labelled) of the handle 310*a* and the handle 310*b*, and the reeds 322*a* and 322*b* may be respectively buckled by the buckle portions (not labelled) of the handle 310*a* and the handle 310*b*.

In this way, the roller exercising device 300, the connecting rod 320, the handle 310*a*, and the handle 310*b* may be combined as the exercising device 300' for the user to perform a rolling operation. For example, the user may use the exercising device 300' based on the way of using the conventional ab-roller. That is, the user may hold the handle 310*a* and the handle 310*b* with both hands and push out the exercising device 300' out in a standing position or kneeling position. Next, the user may pull the exercising device 300' back to be back to the standing position or kneeling position again, such that the training effects can be achieved.

In one embodiment, when the user wants to remove the handle 310*a* and the handle 310*b* from the connecting rod 320, the user may press the release buttons (not labelled) on the handle 310*a* and the handle 310*b* to release the reeds 322*a* and 322*b* buckled by the buckle portions (not labelled) on the handle 310*a* and the handle 310*b*.

Other than the handle 310*a*, the handle 310*b*, and the connecting rod 320, the roller exercising device 300 may be assembled with other types of handles and connecting rods to form a device similar to the exercising device 300'. For example, the connecting rod 320 may be replaced with any rod that is suitable for penetrating the roller exercising device 300, and the handle 310*a* and the handle 310*b* may be correspondingly replaced with any objects that can sleeve on two ends of the rod and be held by the user, but the present disclosure is not limited thereto.

By contrast, the handle 310*a*, the handle 310*b*, and the connecting rod 320 may be used with other types of roller exercising devices to form a device similar to the exercising device 300', rather than limited to be assembled with the roller exercising device 300 shown in FIG. 3A, FIG. 3B, and FIG. 3C. For example, the roller exercising device 300 may be replaced with any roller exercising device disposed with a central through hole for the connecting rod 320 to penetrate. Afterwards, the handle 310*a* and the handle 310*b* may be connected with the two ends of the connecting rod 320 based on the above teachings for the user to hold, but the present disclosure is not limited thereto.

Figure 4A:
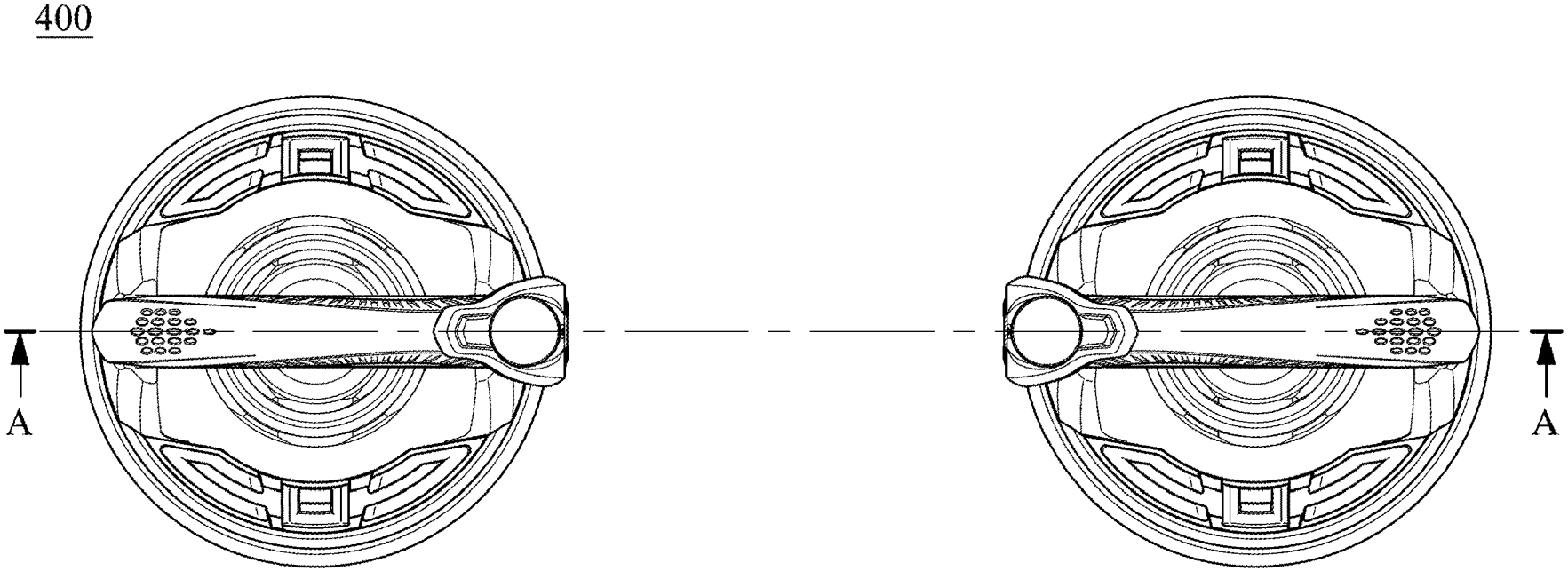
FIG. 4A is a top view of assembling a roller exercising device set.
Figure 4B:
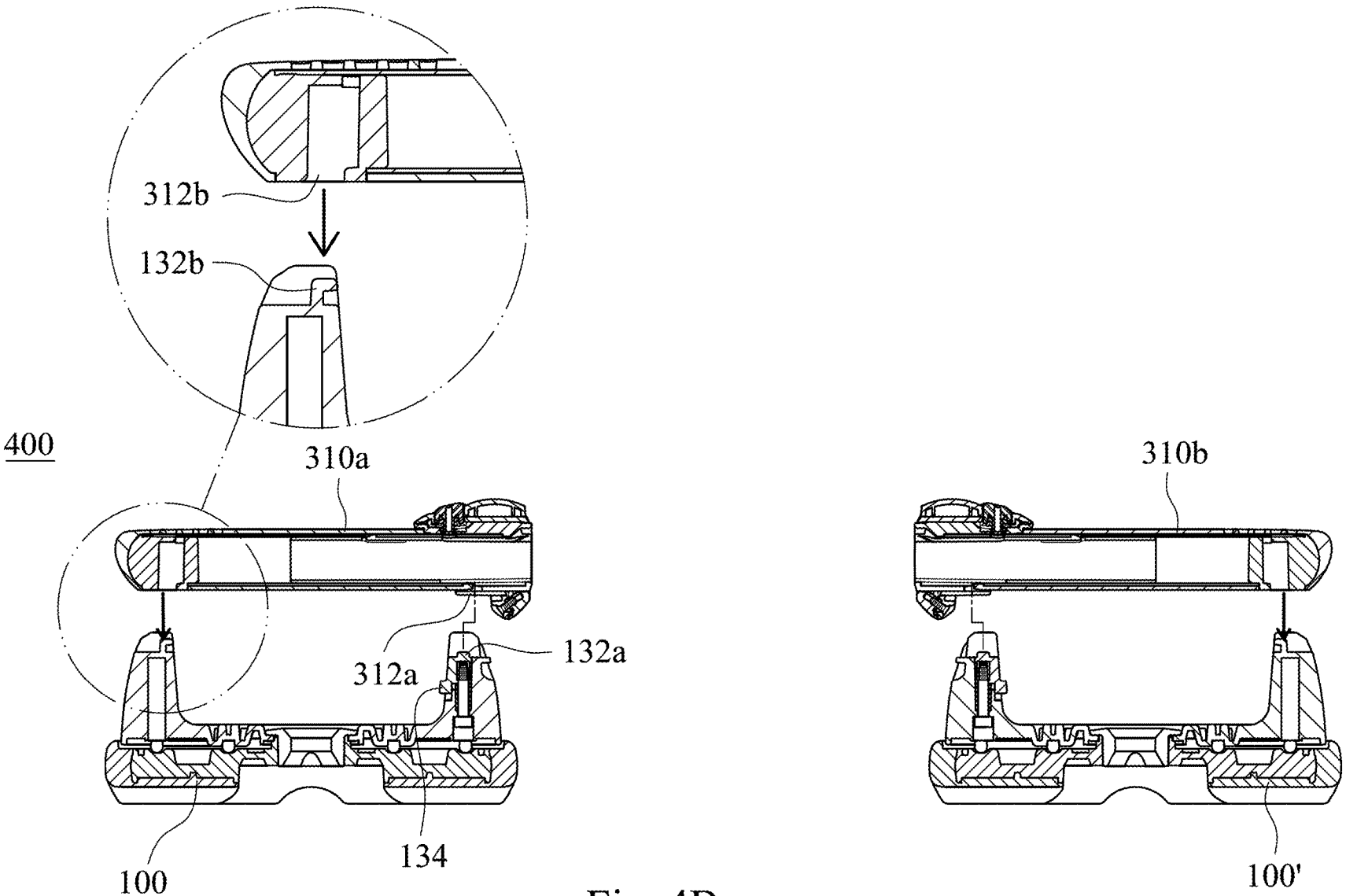
FIG. 4B is a side cross-sectional view along the A-A segment of FIG. 4A.
Figure 4C:
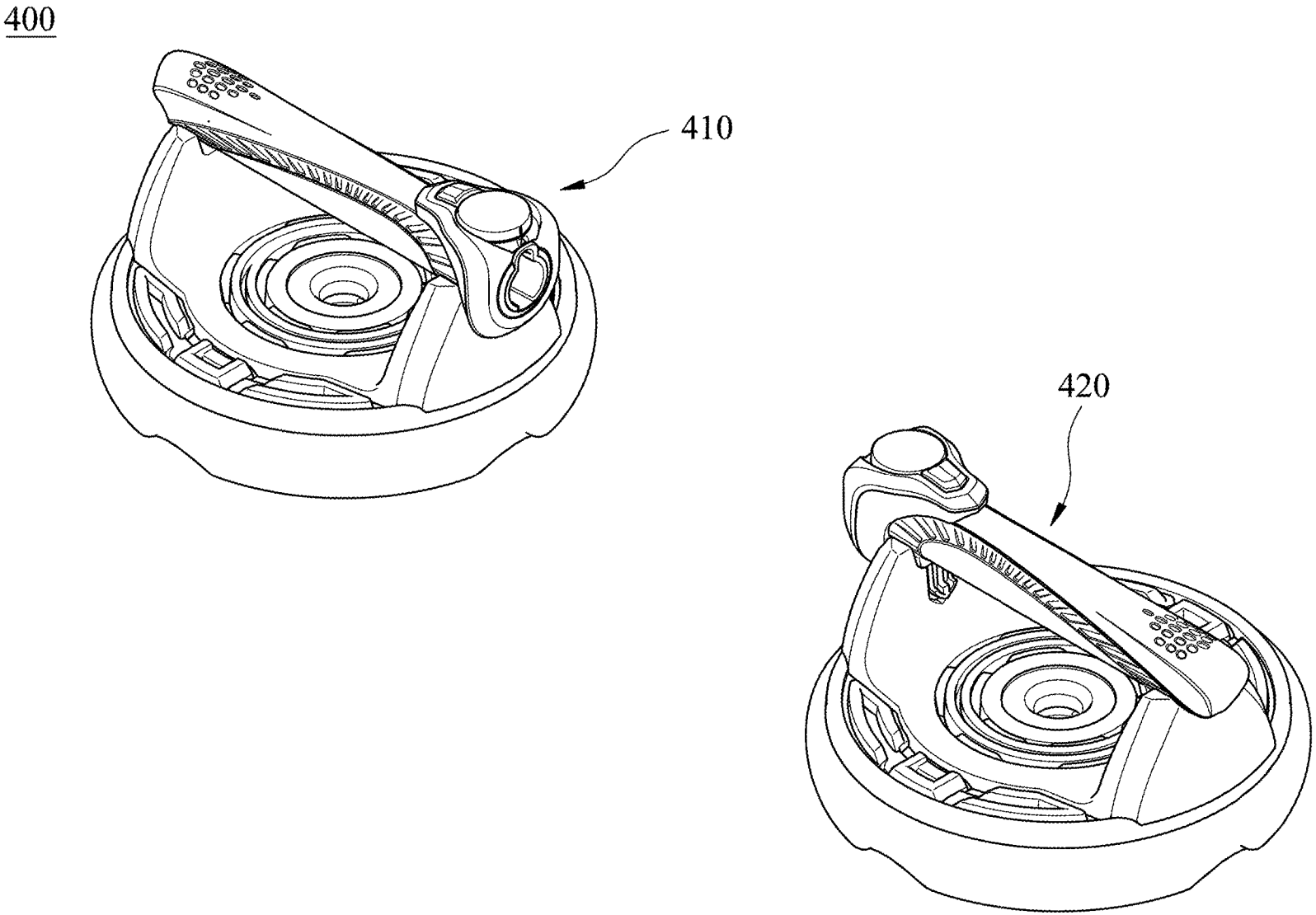
FIG. 4C is a 3-D view of the assembled roller exercising device set of FIG. 4A.

See FIG. 4A, FIG. 4B, and FIG. 4C, wherein FIG. 4A is a top view of assembling a roller exercising device set 400, FIG. 4B is a side cross-sectional view along the A-A segment of FIG. 4A, and FIG. 4C is a 3-D view of the assembled roller exercising device set 400 of FIG. 4A. In the present embodiment, the roller exercising device set 400 includes the first roller exercising device 100, the second roller exercising device 100', the handle 310*a*, and the handle 310*b*. As mentioned before, the handle 310*a* and the handle 310*b* may be the same as the handle exercising device 200 shown in FIG. 2A. In this case, since the male buckle 132*a* and the male buckle 132*b* of the first roller exercising device 100 may respectively buckle the female buckle 250*a* and the female buckle 250*b* of the handle exercising device 200, the male buckle 132*a* and the male buckle 132*b* of the first roller exercising device 100 may respectively buckle the female buckle 312*a* and the female buckle 312*b* of the handle 310*a*. Accordingly, the first roller exercising device 100 and the handle 310*a* may be assembled as an exercising device 410. Similarly, the second roller exercising device 100' and the handle 310*b* may be assembled as an exercising device 420.

As a result, the user may hold the handle 310*a* and the handle 310*b* on the exercising devices 410 and 420 to perform a push-up operation. Further, since each of the first roller exercising device 100 and the second roller exercising device 100' is disposed with the rotary plate 120, the rotary plate 120 on each of the first roller exercising device 100 and the second roller exercising device 100' may rotate along with the rotation of the wrists of the user, and hence a safer movement pattern can be achieved.

In one embodiment, the handle 310*a* may be disposed with a sensor to detect the number of the rotary plate 120 of the first roller exercising device 100 rotating on the base 110, such that the number of the push-ups performed by the user can be monitored.

In one embodiment, when the user wants to remove the handle 310*a* from the first roller exercising device 100, the user may press the release button 134 on the first roller exercising device 100 to release the buckling status of the male buckle 132*a*, such that the female buckle 312*a* on the handle 310*a* may be released, and hence the handle 310*a* can be removed from the first roller exercising device 100.

Other than the handle 310*a* and the handle 310*b*, it is noted that the first roller exercising device 100 and the second roller exercising device 100' may be assembled with other types of handles to form exercising devices similar to the exercising device 410 and the exercising device 420. For example, the handle 310*a* and the handle 310*b* may be replaced with other handles disposed with female buckles. As long as the female buckles on these handles can correspond to the male buckles on the first roller exercising device 100 and the second roller exercising device 100', these handles can be assembled with the first roller exercising device 100 and the second roller exercising device 100' to form exercising devices similar to the exercising device 410 and the exercising device 420. Therefore, the user may use these exercising devices to perform the push-up operation, but the present disclosure is not limited thereto.

By contrast, the handle 310*a* and the handle 310*b* may be assembled with other types of roller exercising devices to form exercising devices similar to the exercising device 410 and the exercising device 420. For example, the first roller exercising device 100 and the second roller exercising device 100' may be replaced with roller exercising devices disposed with male buckles. As long as the male buckles on these roller exercising devices can correspond to the female buckles on the handle 310*a* and the handle 310*b*, these roller exercising devices may be assembled with the handle 310*a* and the handle 310*b* to form exercising devices similar to the exercising device 410 and the exercising device 420. Therefore, the user may use these exercising devices to perform the push-up operation, but the present disclosure is not limited thereto.

Figure 5A:
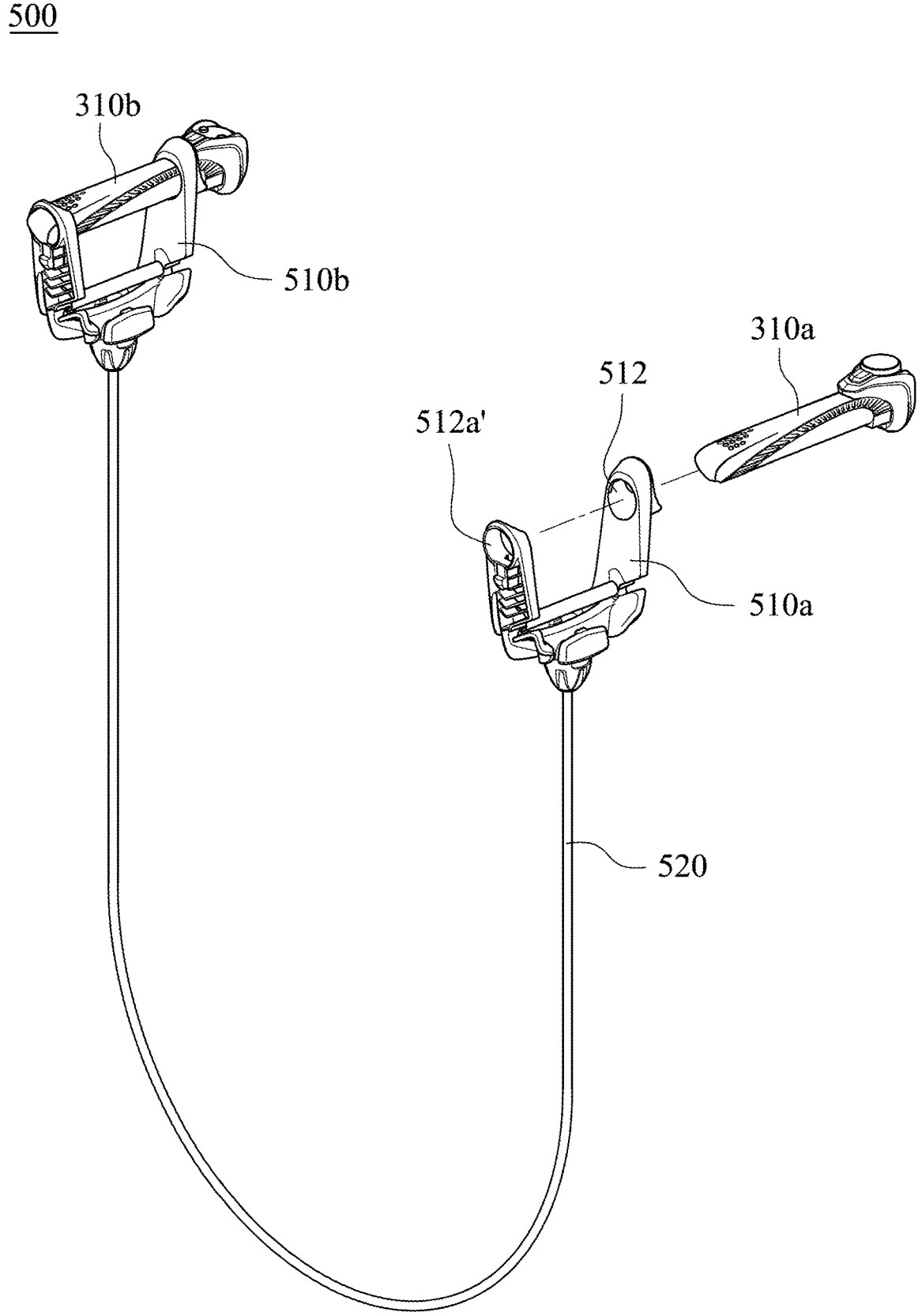
FIG. 5A is a schematic view of assembling an exercising device set of one embodiment of the present disclosure.
Figure 5B:
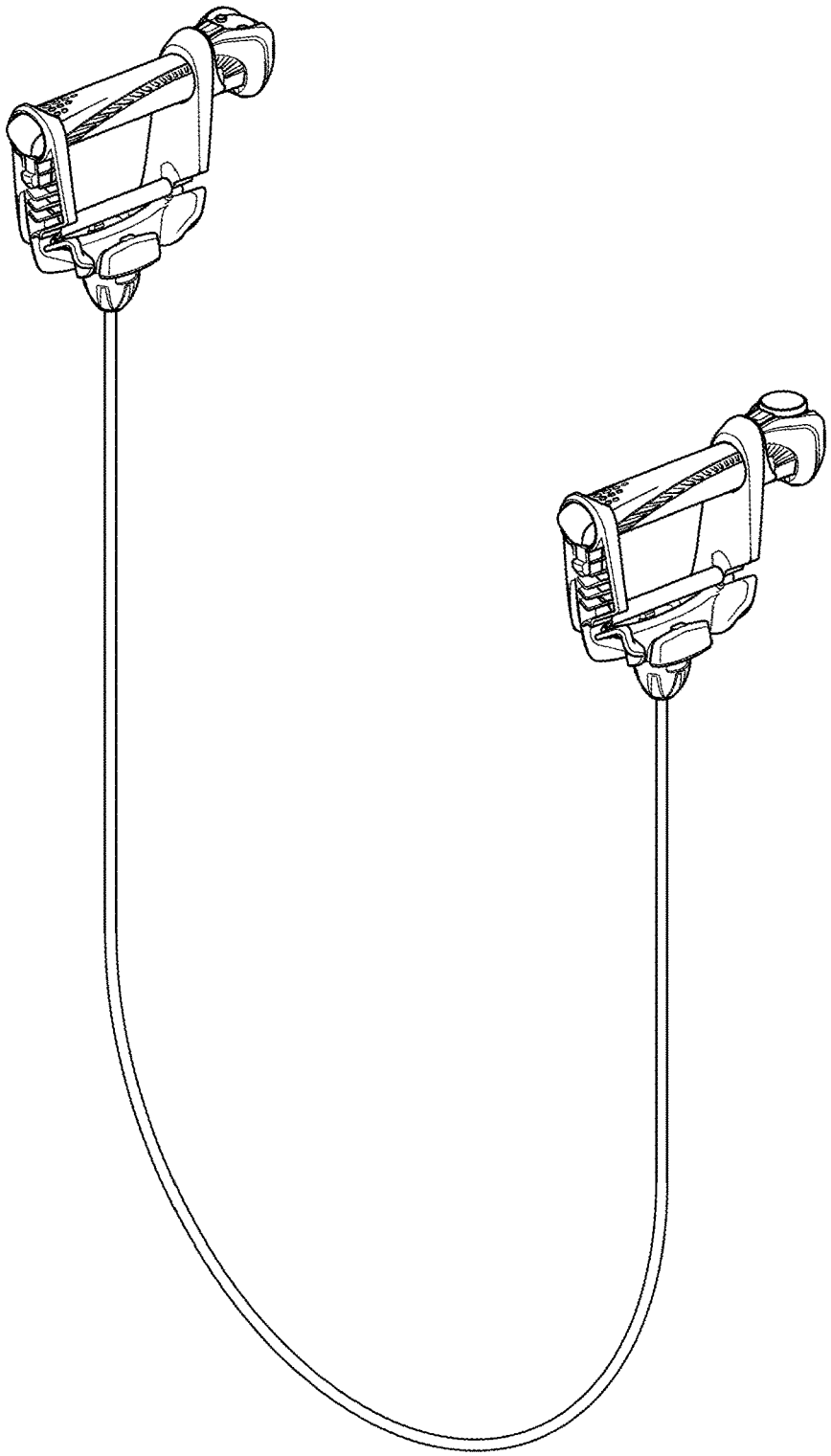
FIG. 5B is a schematic view of the assembled exercising device set.

See FIG. 5A and FIG. 5B, wherein FIG. 5A is a schematic view of assembling an exercising device set 500 of one embodiment of the present disclosure, and FIG. 5B is a schematic view of the assembled exercising device set 500. In the present embodiment, the exercising device set 500 includes the handle 310*a*, the handle 310*b*, a first handle case 510*a*, a second handle case 510*b*, and an elastic rope 520. The first handle case 510*a* is U-shaped, and two ends of the first handle case 510*a* are disposed with a through hole 512*a* and a through hole 512*a'*. The through hole 512*a* and the through hole 512*a'* are aligned with each other. The second handle case 510*b* may be the same as the first handle case 510*a*, and hence the details of the second handle case 510*b* will not be further described. Two ends of the elastic rope 520 may be respectively connected with the first handle case 510*a* and the second handle case 510*b*.

As shown in FIG. 5A, the handle body of the handle 310*a* may penetrate the through hole 512*a* and the through hole 512*a'* of the first handle case 510*a*, and the handle body of the handle 310*b* may penetrate the through holes of the second handle case 510*b*. The handle 310*a*, the handle 310*b*, the first handle case 510*a*, the second handle case 51013, and the elastic rope 520 may be combined as the exercising device set 500 (e.g., a pulling rope) shown in FIG. 5B. In this way, the user may use the exercising device set 500 to perform movements such as pulling the handle 310*a* and the handle 310*b* with both hands while stepping on the elastic rope 520, and hence the training effects may be achieved.

Figure 6A:
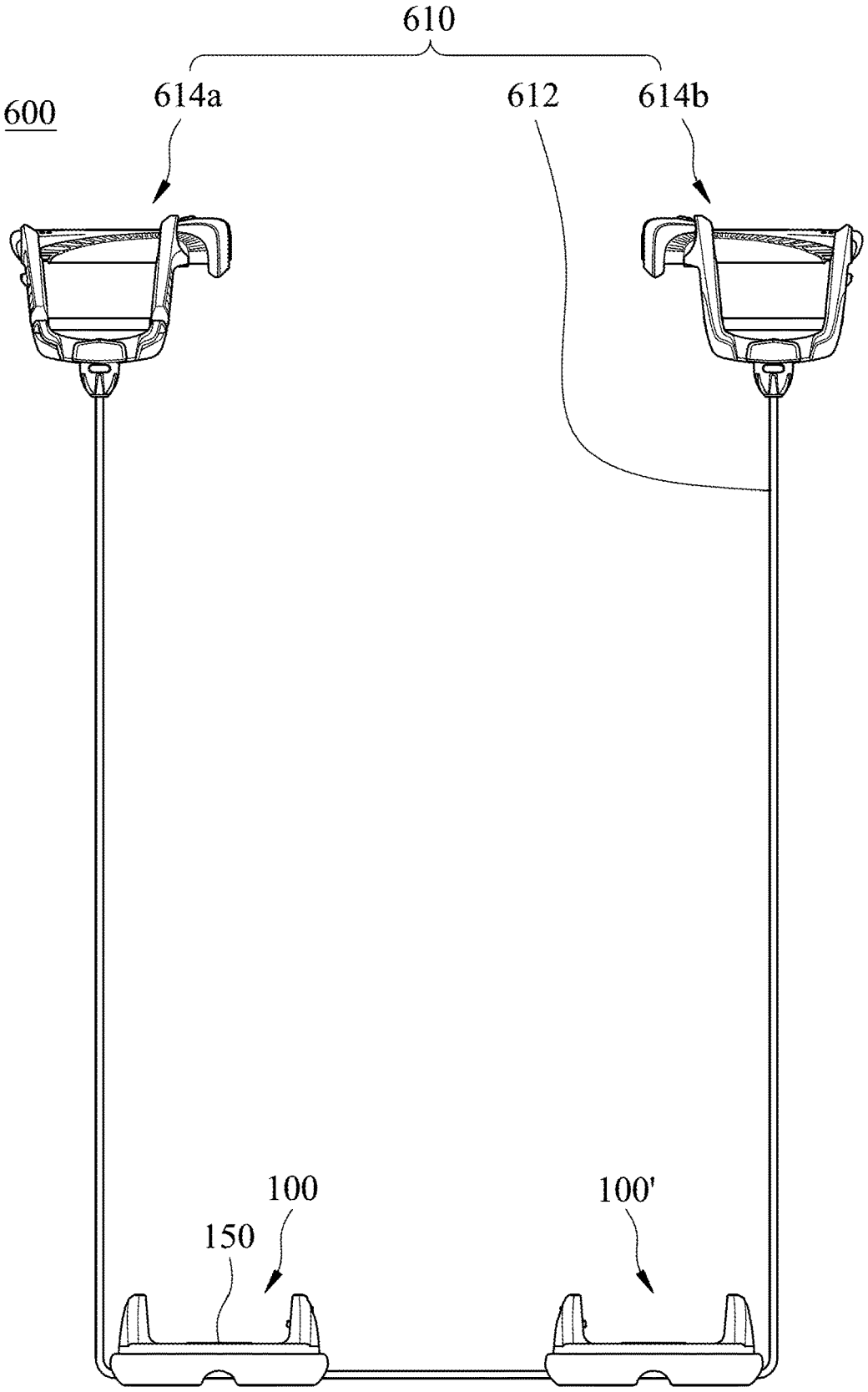
FIG. 6A is a front view of a roller exercising device set of one embodiment of the present disclosure.
Figure 6B:
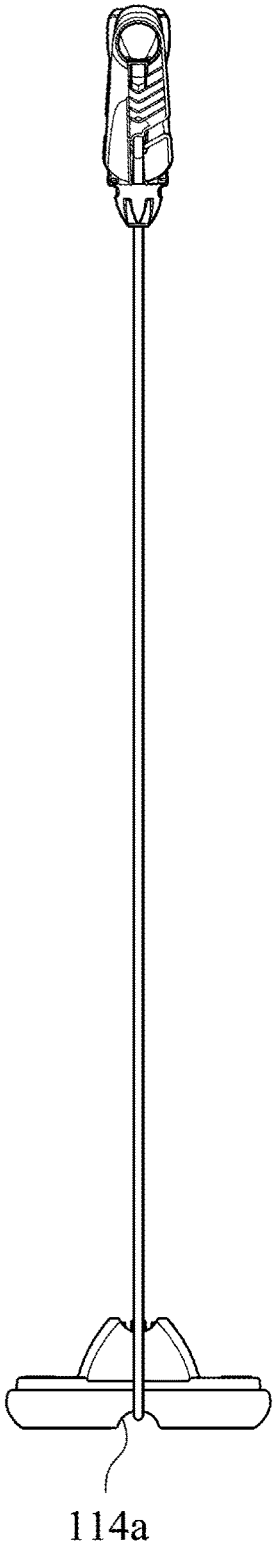
FIG. 6B is a side view of the roller exercising device set of FIG. 6A.

See FIG. 6A and FIG. 6B, wherein FIG. 6A is a front view of a roller exercising device set 600 of one embodiment of the present disclosure, and FIG. 6B is a side view of the roller exercising device set 600 of FIG. 6A. In the present embodiment, the roller exercising device set 600 includes the first roller exercising device 100, the second roller exercising device 100', and the pulling rope 610. The pulling rope 610 includes an elastic rope 610, a holding portion

614*a*, and a holding portion 614*b*. The holding portion 614*a* and the holding portion 614*b* are connected with two ends of the elastic rope 612.

As shown in FIG. 6A and FIG. 6B, the pulling rope 610 may be the same as the exercising device set 500 shown in FIG. 5A and FIG. 5B. That is, the holding portion 614*a* may be formed by assembling the handle 310*a* with the first handle case 510*a*, and the holding portion 614*b* may be formed by assembling the handle 310*b* with the second handle case 510*b*, but the present disclosure is not limited thereto.

In the present embodiment, the elastic rope 612 may go through the limiting slots 114*a* of the first roller exercising device 100 and the second roller exercising device 100' to form the roller exercising device set 600.

In this way, the user may step the stepping portion 150 of the first roller exercising device 100 and the stepping portion (not labelled) of the second roller exercising device 100' with both feet and hold the holding portion 614*a* and the holding portion 614*b* with both hands. As a result, the user may use the pulling rope 610 to perform movements (such as bicep curl) while using the first roller exercising device 100 and the second roller exercising device 100' to reciprocatingly twist his/her body, such that a better movement variability can be achieved. In one embodiment, the user may reciprocatingly twist his/her body by simply stepping on the first roller exercising device 100 and the second roller exercising device 100'.

Other than the pulling rope 610 shown in FIG. 6A and FIG. 6B, the first roller exercising device 100 and the second roller exercising device 100' may be used with other types of pulling ropes to form a device similar to the roller exercising device set 600. For example, the pulling rope 610 may be replaced with other conventional pulling ropes disposed with handles and elastic rope, but the present disclosure is not limited thereto.

By contrast, the pulling rope 610 may be used with other types of rotary plates to form a device similar to the roller exercising device set 600. For example, the first roller exercising device 100 and the second roller exercising device 100' may be replaced with any devices that can rotate along with the rotations of the user's feet and have limiting slots that allow the elastic rope 612 to go through, but the present disclosure is not limited thereto.

Figure 7A:
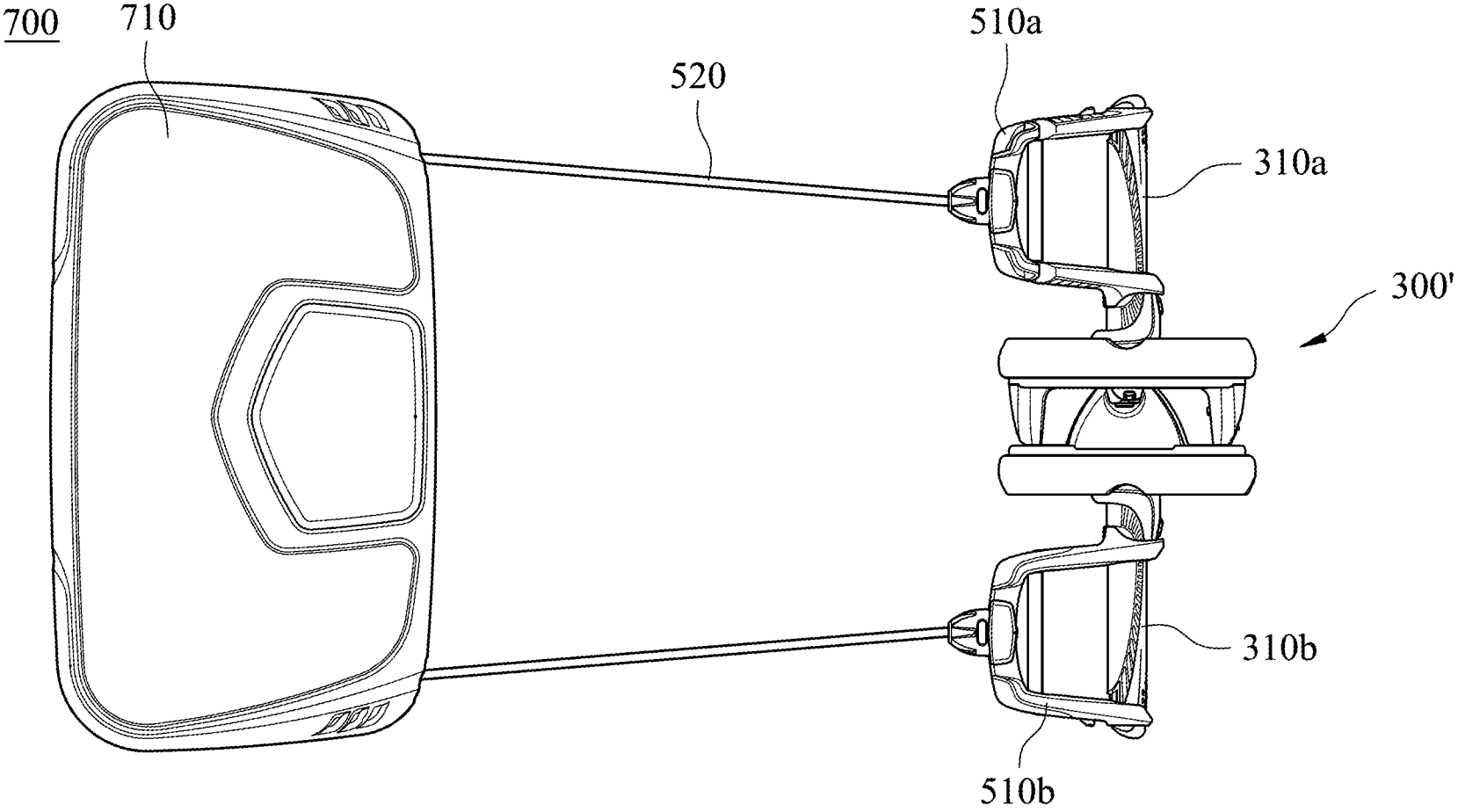
FIG. 7A is a top view of an exercising device set of one embodiment of the present disclosure.
Figure 7B:
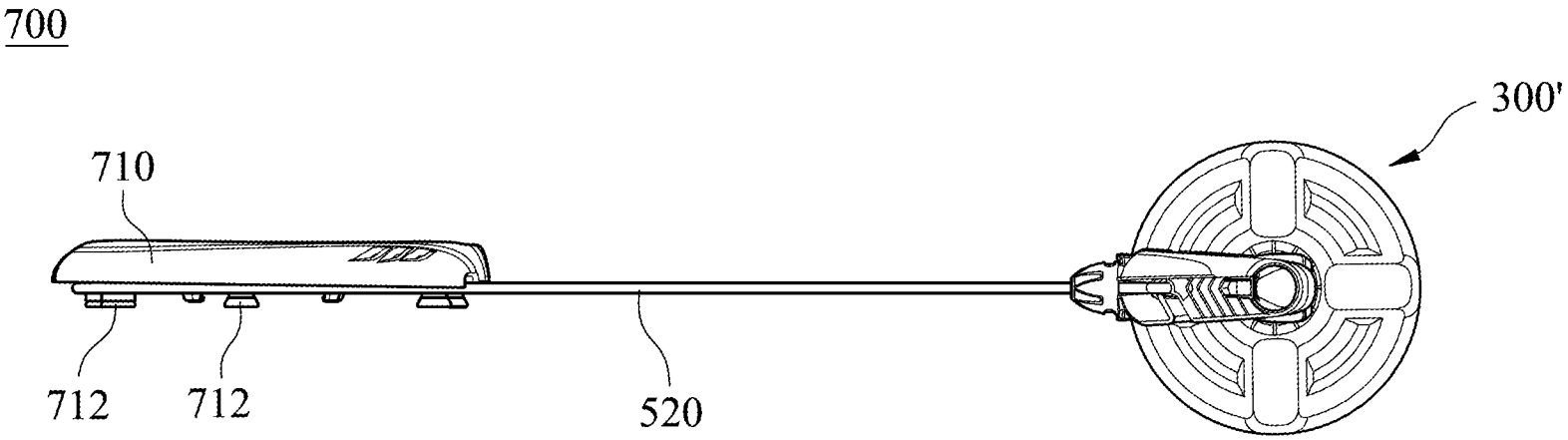
FIG. 7B is a side view of the exercising device set of FIG. 7A.
Figure 7C:
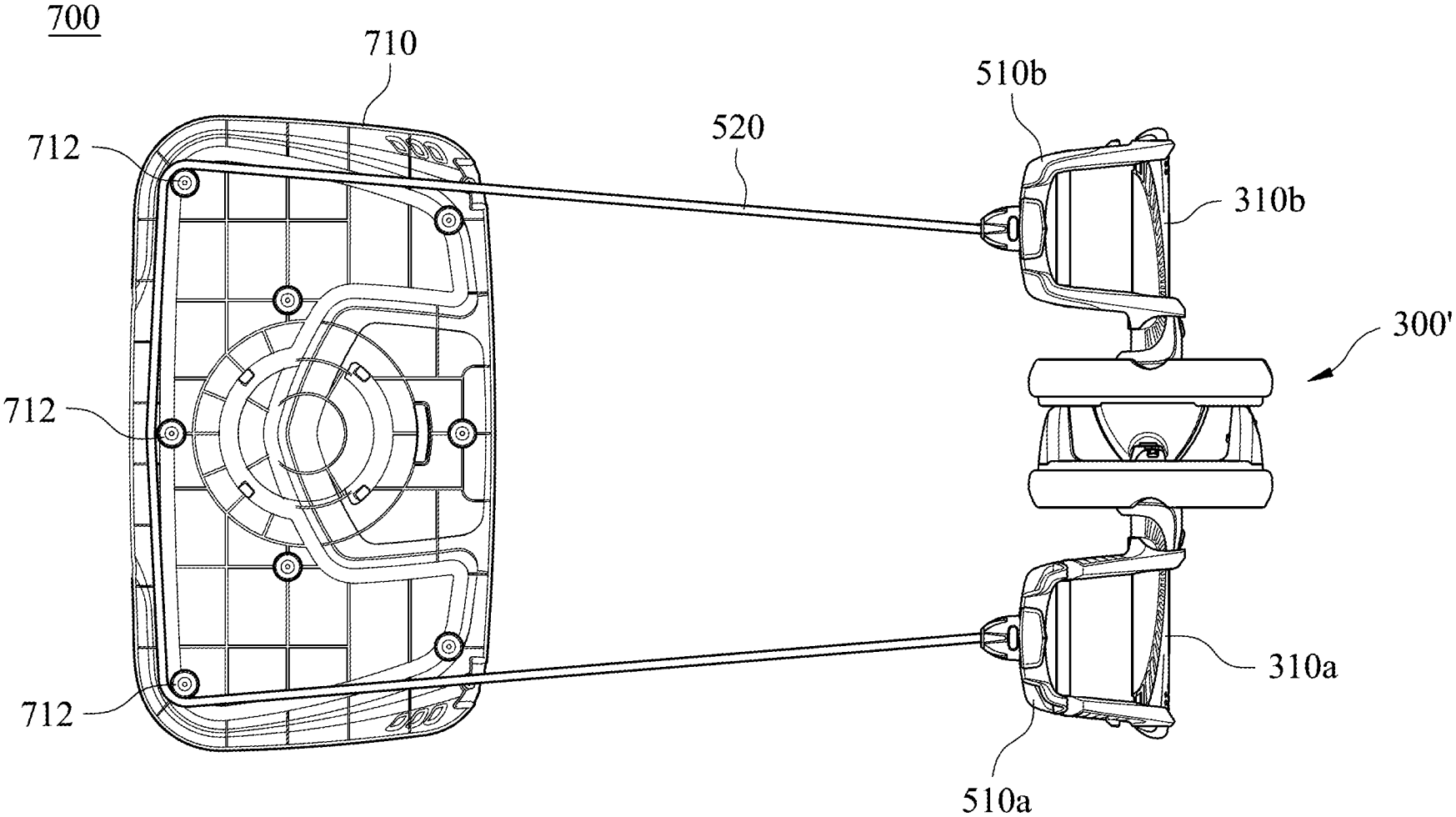
FIG. 7C is a bottom view of the exercising device set of FIG. 7A.

See FIG. 7A, FIG. 7B, and FIG. 7C, wherein FIG. 7A is a top view of an exercising device set 700 of one embodiment of the present disclosure, FIG. 7B is a side view of the exercising device set 700 of FIG. 7A, and FIG. 7C is a bottom view of the exercising device set 700 of FIG. 7A. In the present embodiment, the exercising device set 700 includes the exercising device 300', the first handle case 510*a*, the second handle case 510*b*, the elastic rope 520, and a kneeling pad 710. The way that the handle 310*a* and the handle 310*b* of the exercising device 300' assembled with the first handle case 510*a* and the second handle case 510*b* may be referred to the related descriptions of FIG. 5A and FIG. 5B, which will not be repeated herein.

A plurality of pillars 712 are disposed at a bottom surface of the kneeling pad 710, and the elastic rope 520 may twine the pillars 712. In this way, when the user kneels on the kneeling pad 710, the user may hold the handle 310*a* and the handle 310*b* with both hands to perform the aforementioned rolling operation in a kneeling position. Meanwhile, the elastic force provided by the elastic rope 520 may assist the user to pull the exercising device 300' back, such that the risk of getting injured during the rolling operation may be reduced.

Figure 8A:
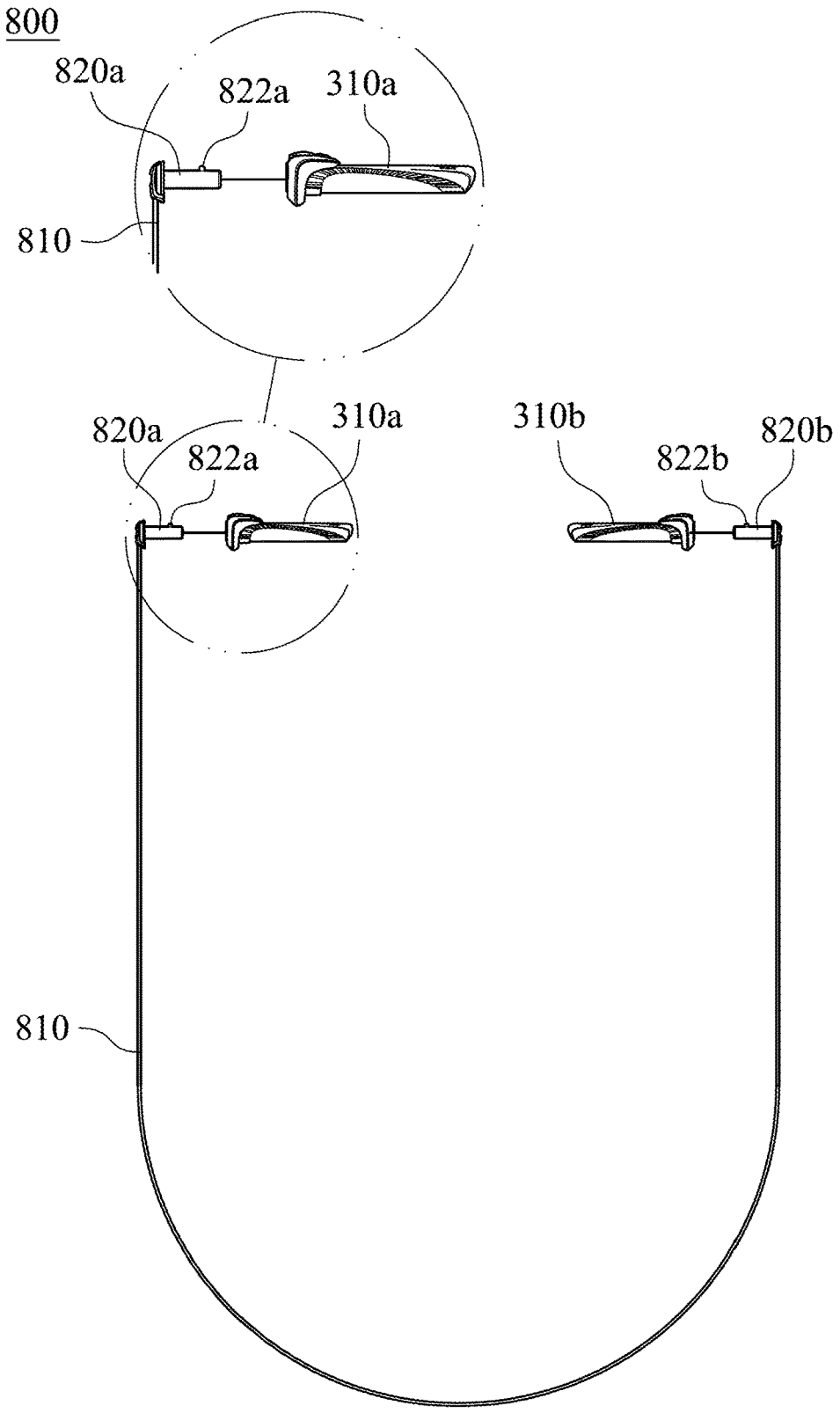
FIG. 8A is a schematic view of assembling an exercising device set.
Figure 8B:
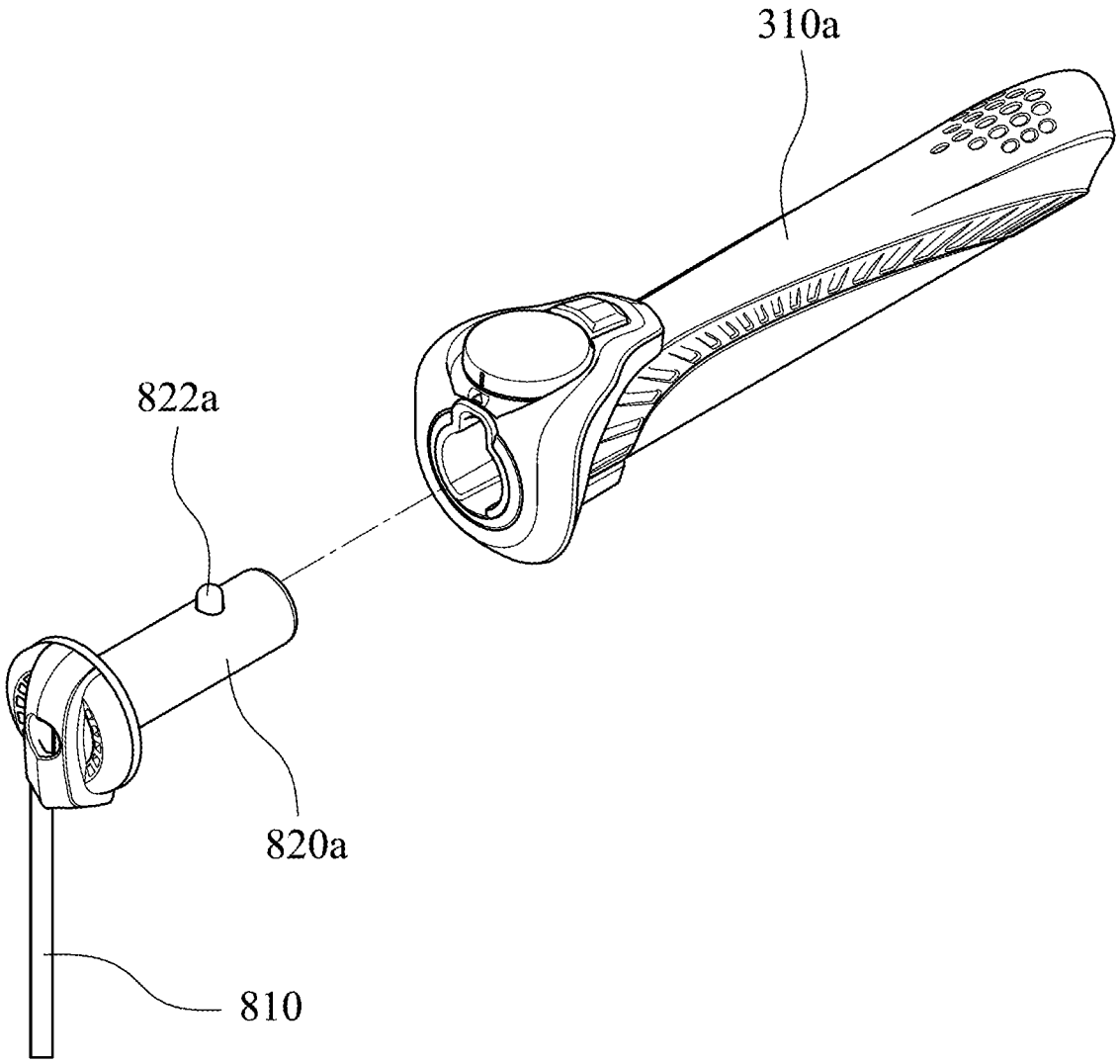
FIG. 8B is a schematic view of assembling the handle with an inserting portion of FIG. 8A.
Figure 8C:
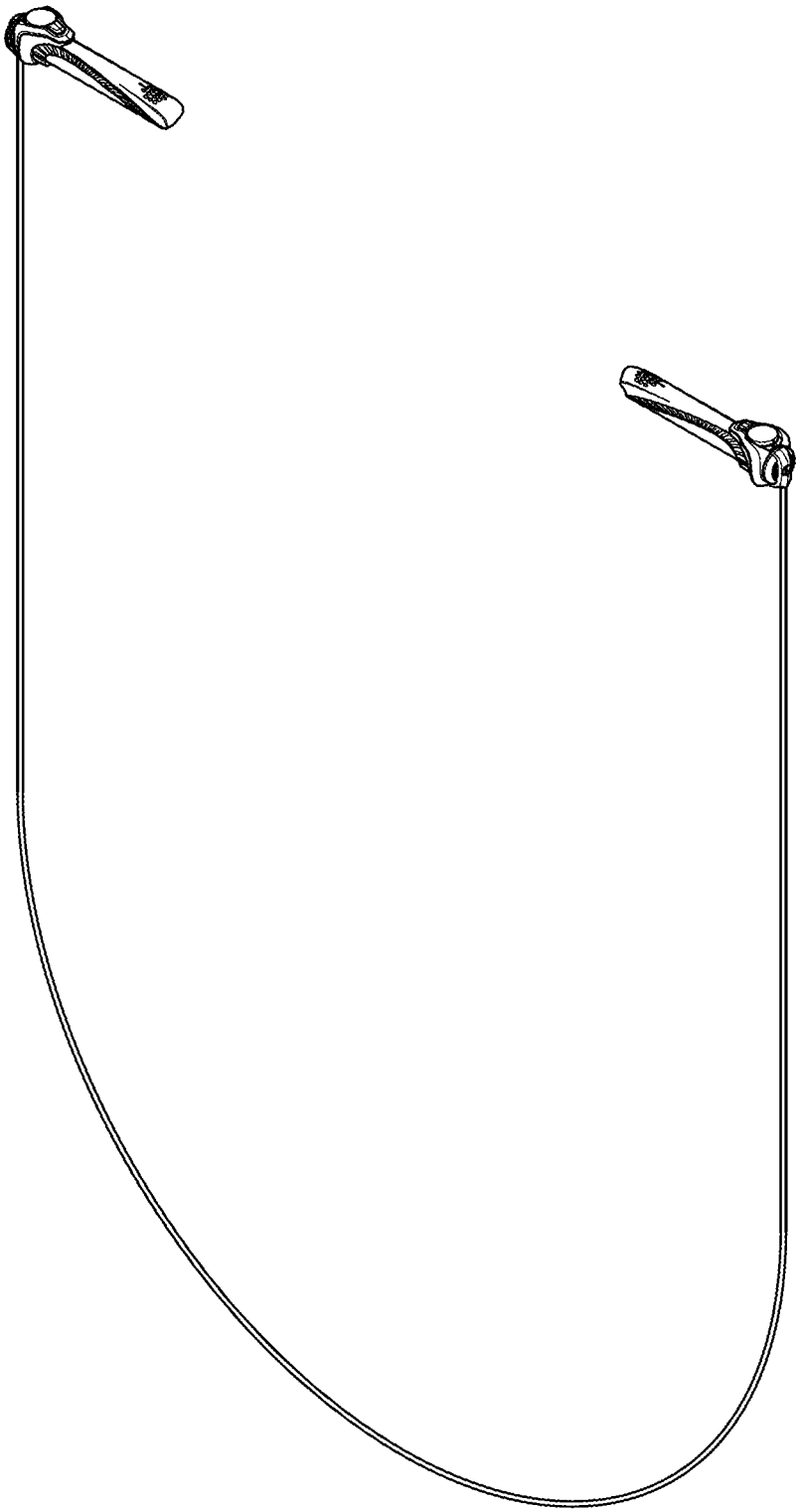
FIG. 8C is a schematic view of the assembled exercising device set.

See FIG. 8A, FIG. 8B, and FIG. 8C, wherein FIG. 8A is a schematic view of assembling an exercising device set 800, FIG. 8B is a schematic view of assembling the handle 310*a* with an inserting portion 820*a* of FIG. 8A, and FIG. 8C is a schematic view of the assembled exercising device set 800. In the present embodiment, the exercising device set 800 includes a rope 810, the handle 310*a*, and the handle 310*b*. Two ends of the rope 810 are disposed with the inserting portion 820*a* and an inserting portion 820*b*, wherein the inserting portion 820*a* and the inserting portion 820*b* are respectively disposed with reeds 822*a* and 822*b*. In one embodiment, the reeds 822*a* and 822*b* may be the same as the reeds 322*a* and 322*b* shown in FIG. 3A and FIG. 3B, but the present disclosure is not limited thereto.

As shown in FIG. 8A and FIG. 8B, the inserting portion 820*a* and the inserting portion 820*b* of the rope 810 may respectively insert the chambers of the handle 310*a* and the handle 310*b*. The reeds 822*a* and 822*b* may be respectively buckled by the buckle portions of the handle 310*a* and the handle 310*b*. In this way, the rope 810, the handle 310*a*, and the handle 310*b* may be combined as the exercising device set 800 for a jumping rope operation.

In one embodiment, when the user wants to remove the inserting portion 820*a* and the inserting portion 820*b* of the rope 810 from the handle 310*a* and the handle 310*b*, the user may press the release buttons (not labelled) on the handle 310*a* and the handle 310*b* to release the reeds 822*a* and 822*b* buckled by the buckle portions (not labelled) of the handle 310*a* and the handle 310*b*.

In one embodiment, the handle 310*a* or the handle 310*b* may be disposed with a sensor for detecting the number of the rope 810 rotates, such that the number of the user performing the jumping rope operation can be monitored. The sensor may be a g-sensor, but the present disclosure is not limited thereto.

Figure 9A:
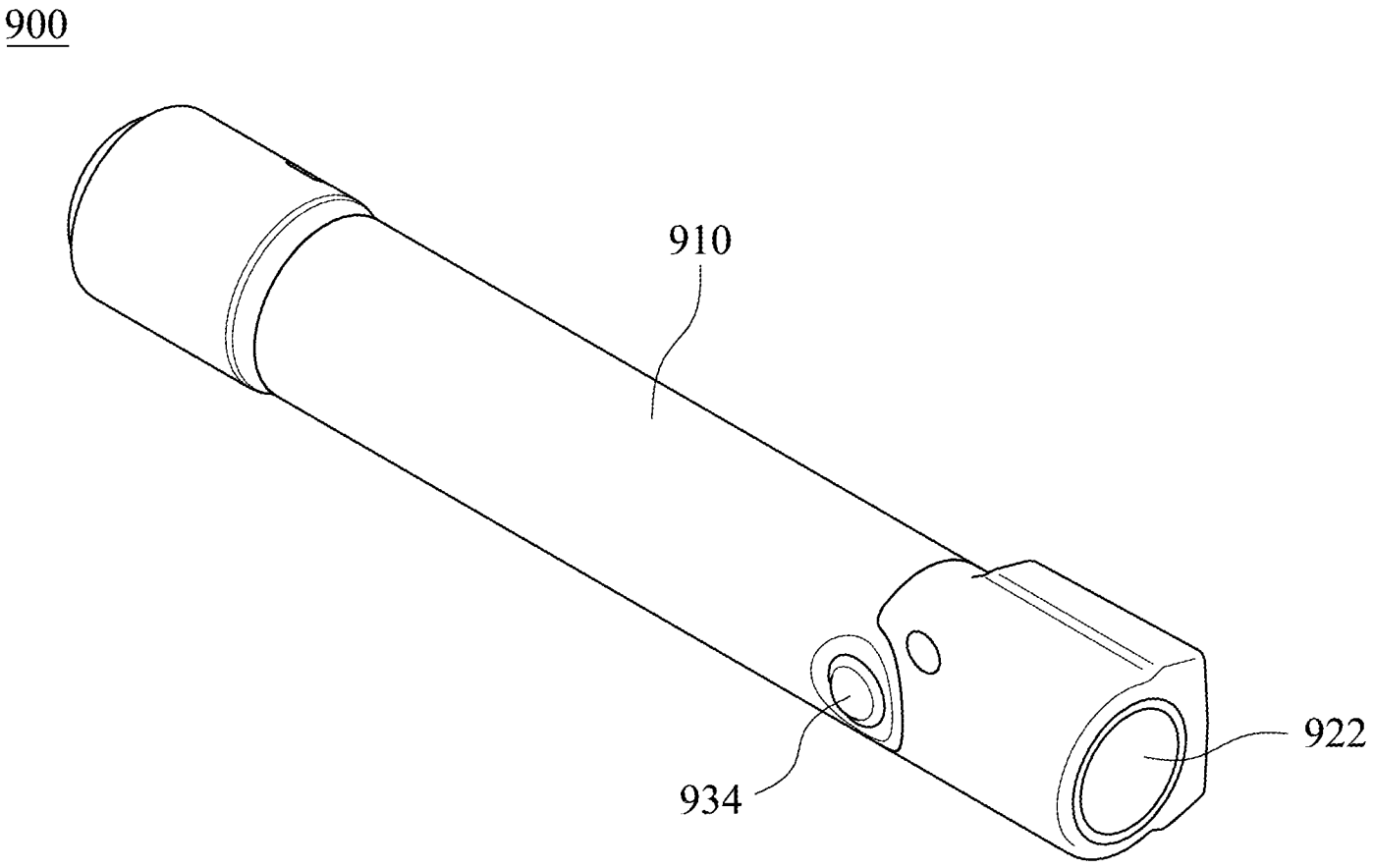
FIG. 9A is a schematic view of a handle exercising device of one embodiment of the present disclosure.
Figure 9B:
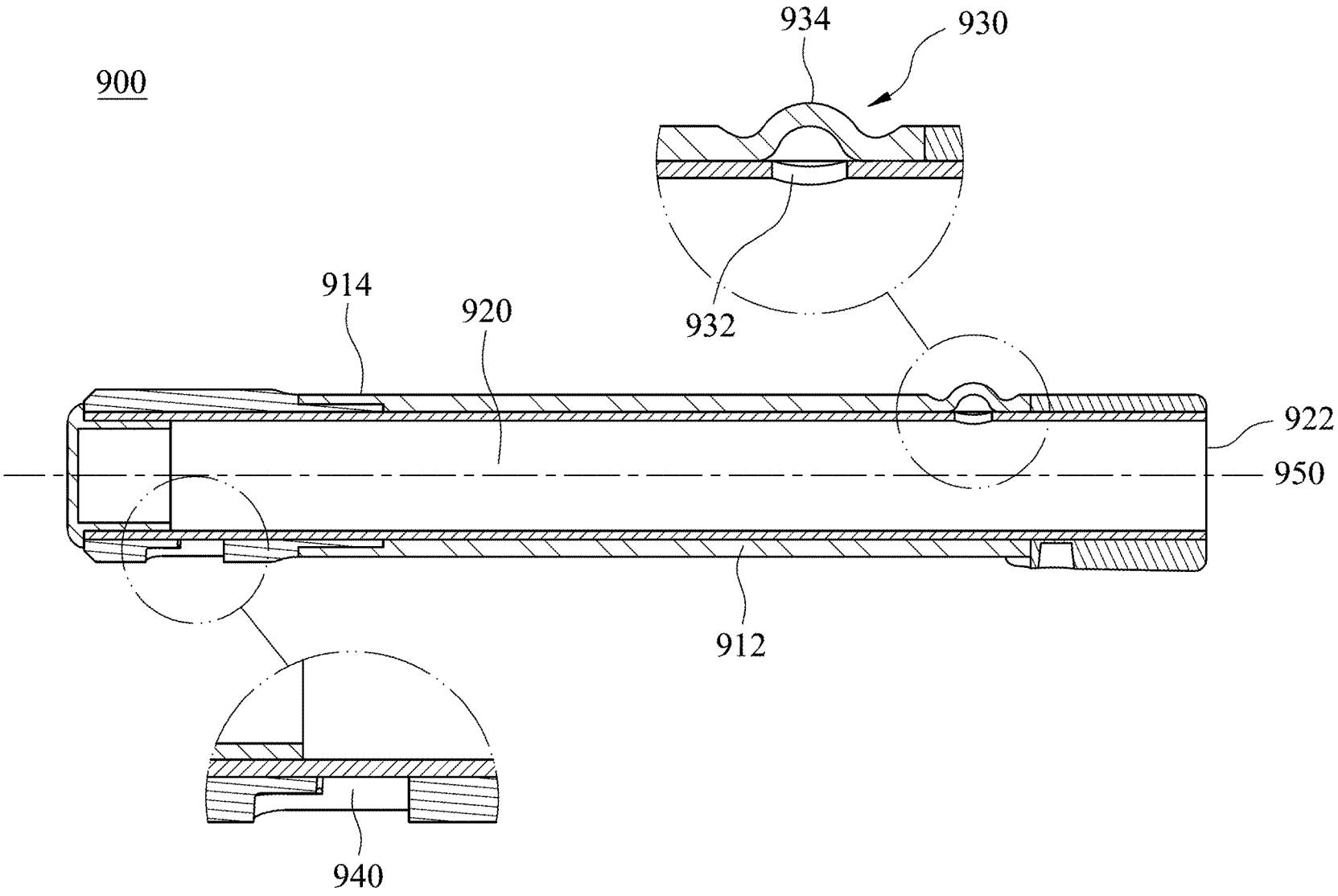
FIG. 9B is a side cross-sectional view of the handle exercising device.

See FIG. 9A and FIG. 9B, wherein FIG. 9A is a schematic view of a handle exercising device 900 of one embodiment of the present disclosure, and FIG. 9B is a side cross-sectional view of the handle exercising device 900. The handle exercising device 900 may be used to replace the handles mentioned in the previous embodiments (e.g., the handle 310*a* and the handle 310*b*), and the details thereof will be discussed hereinafter.

As shown in FIG. 9A and FIG. 9B, the handle exercising device 900 includes a handle body 910, an accommodating space 920, an engaging portion 930, and a female buckle 940. The handle body 910 has a top surface 914 and a bottom surface 912 and may be covered by a polyurethane or poly foam for facilitating the user to hold. The accommodating space 920 may be disposed in the handle body 910 along an axial direction 950 of the handle body 910, wherein the accommodating space 920 has an opening 922 facing one end of the handle body 910. In the present embodiment, the accommodating space 920 is a chamber, but the accommodating space 920 may be a through hole in other embodiments as well. The female buckle 940 disposed at the bottom surface 912 of the handle body 910 and closer to one end of the handle body 910. In the present embodiment, the female buckle 940 may be disposed at the end opposite to where the opening 922 locates, but the female buckle 940 and the opening 922 may be disposed at the same end in other embodiments as well.

The engaging portion 930 is disposed in the accommodating space 920 and engages the predetermined assemblies inserting the accommodating space 920 via the opening 922. In the present embodiment, if the engaging portion 930 is used to engage the connecting rod 320 of FIG. 3A or the reed

822*a* of the inserting portion 820*a* of FIG. 8B, the engaging portion 930 may include a buckle portion 932 to buckle the connecting rod 320 or the reed 822*a* of the inserting portion 820*a* inserting via the opening 922. Correspondingly, the handle exercising device 900 may further include a release button 934 disposed at the top surface 914 to release the predetermined assemblies (e.g., the connecting rod 320 or the reed 822*a* of the inserting portion 820*a*) buckled by the buckle portion 932.

Figure 9C:
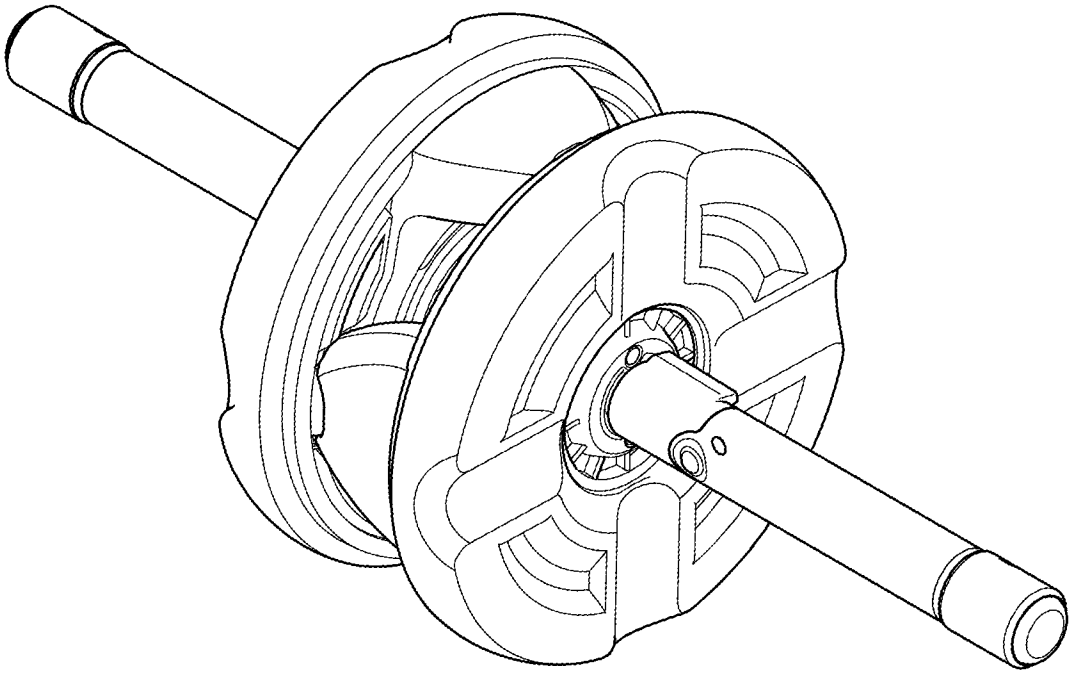
FIG. 9C is a schematic view of an exercising device illustrated based on FIG. 3A, FIG. 3B, FIG. 3C, and FIG. 9A.
Figure 9D:
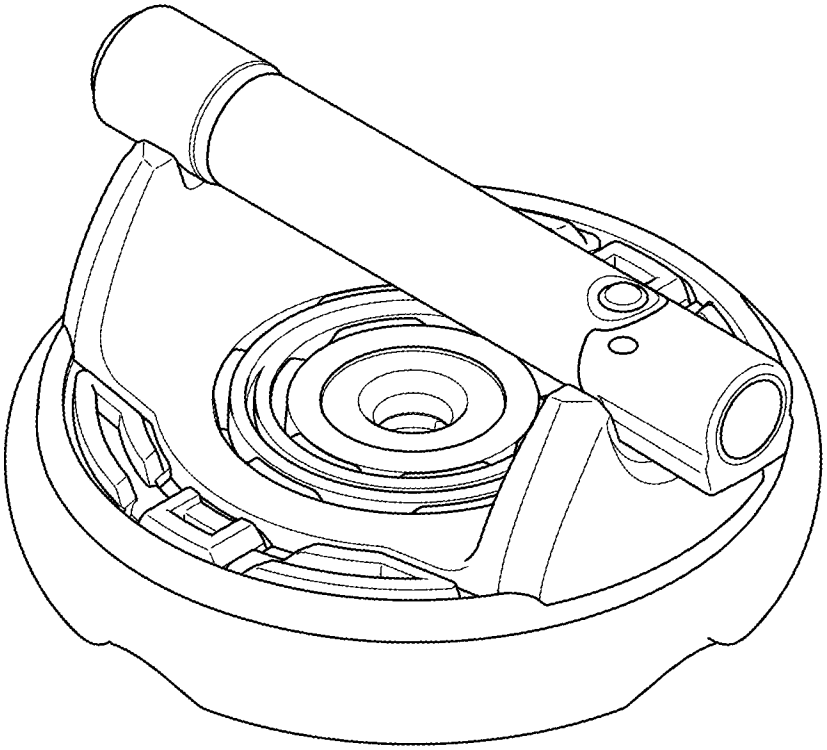
FIG. 9D is a schematic view of an exercising device illustrated based on FIG. 1B and FIG. 9A.

When the handle exercising device 900 is used to replace the handle 310*a* and the handle 310*b* shown in FIG. 3A to FIG. 3C, an exercising device 990 shown in FIG. 9C can be formed, but the present disclosure is not limited thereto. Further, the female buckle 940 may be buckled by the male buckle 132*a* of the first roller exercising device 100 shown in FIG. 1B to form an exercising device 995 of FIG. 9D, but the present disclosure is not limited thereto.

In other embodiments, the engaging portion 930 may be modified to be any structure suitable for engaging the predetermined assemblies.

Figure 10:
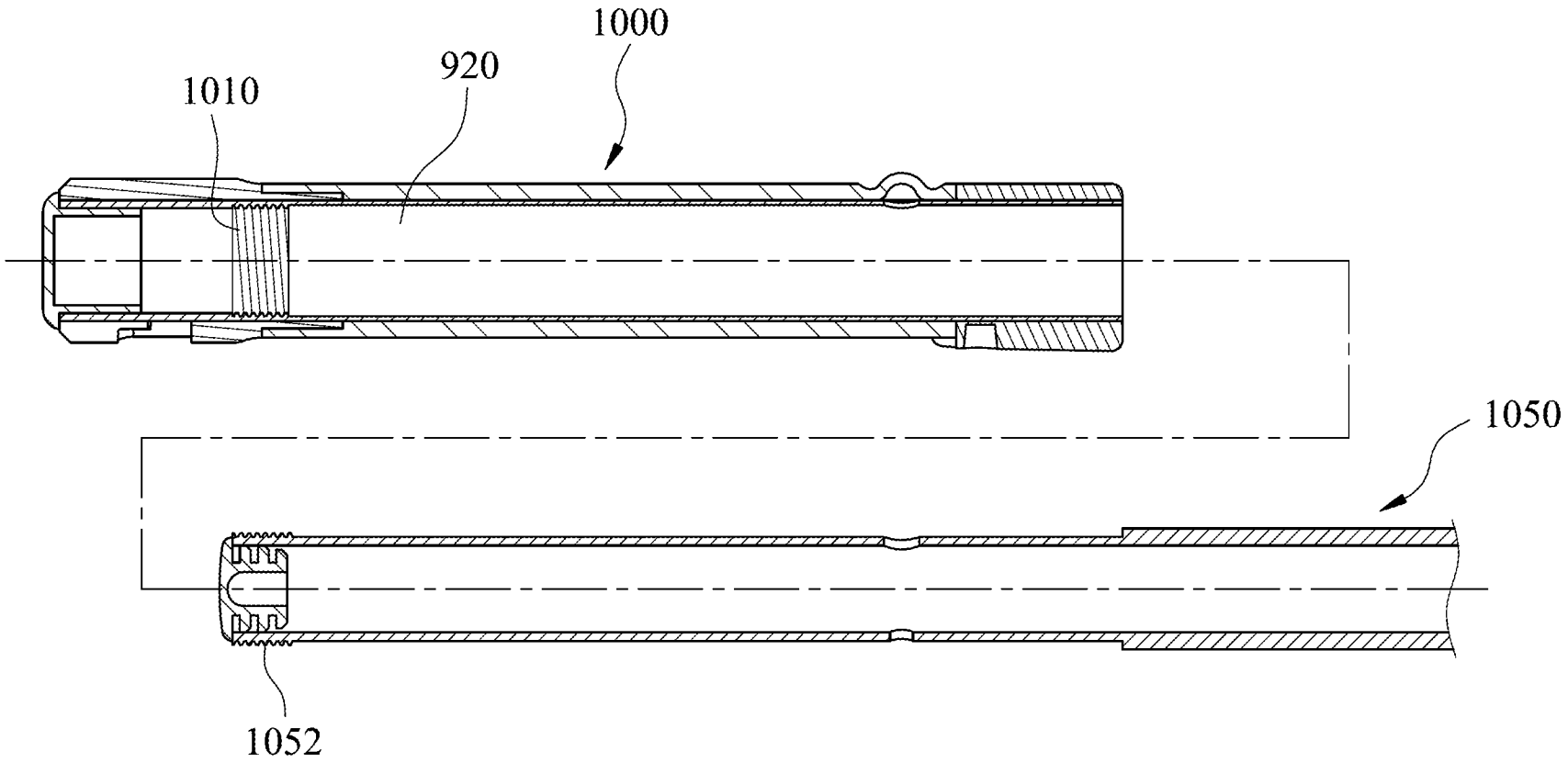
FIG. 10 is a side cross-sectional view of a handle exercising device and a connecting rod according to FIG. 9A.

See FIG. 10, which is a side cross-sectional view of a handle exercising device 1000 and a connecting rod 1050 according to FIG. 9A. In the present embodiment, the connecting rod 1050 may be used to replace the connecting rod 320 shown in FIG. 3A. However, as shown in FIG. 10, the connecting rod 1050 is not disposed with any reed that can be buckled, but with an outer thread segment 1052 disposed at two ends thereof. For simplifying the illustration, only one end of the outer thread segment 1052 is illustrated in FIG. 10, and the outer thread segment at the other end of the connecting rod 1050 is neglected.

Correspondingly, the handle exercising device 1000 may include an inner thread segment 1010 disposed at the other end of the accommodating space 920 of the handle body 910. As a result, when one end of the connecting rod 1050 inserts the accommodating space 920, the handle exercising device 1000 may be connected with the connecting rod 1050 via the inner thread segment 1010 and the outer thread segment 1052 that corresponding to each other, which leads to an engaging way different from the previous embodiments. That is, in FIG. 3A to FIG. 3C, not only the handle 310*a* and the handle 310*b* can be replaced with the handle exercising device 1000, but the connecting rod 320 can be correspondingly replaced with the connecting rod 1050, but the present disclosure is not limited thereto.

To sum up, the handle exercising device proposed in the present disclosure may be combined with different devices, such as the roller exercising device, pulling rope, and kneeling pad. etc., to form various exercising device sets. Moreover, since the user may vary the ways of exercising by assembling the exercising devices with little effort, the handle exercising device may improve the will of the user to do exercises by providing less limitation, more variability, and more fun, such that the training effects can be achieved.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A handle exercising device used with a predetermined assembly, comprising:

a handle body, having a top surface, a bottom surface and a chamber, wherein the chamber is disposed in the handle body along an axial direction of the handle body and has an opening facing one end of the handle body, and the other end of the handle body is closed;

a buckle portion disposed in the chamber and buckling the predetermined assembly inserting the chamber via the opening;

a release button disposed at the top surface of the handle body and connected with the buckle portion to release a buckling status of the buckle portion; and two female buckles fixed disposed at the bottom surface of the handle body and arranged in parallel along the axial direction.

2. The handle exercising device of claim 1, wherein a distance between the two female buckles is wider than a palm.

* * * * *